US008854173B2

(12) United States Patent
Tsuchiya et al.

(10) Patent No.: US 8,854,173 B2
(45) Date of Patent: Oct. 7, 2014

(54) FE-BASED AMORPHOUS ALLOY POWDER, DUST CORE USING THE SAME, AND COIL-EMBEDDED DUST CORE

(71) Applicant: Alps Green Devices Co., Ltd., Tokyo (JP)

(72) Inventors: Keiko Tsuchiya, Niigata-ken (JP); Jun Okamoto, Niigata-ken (JP); Hisato Koshiba, Niigata-ken (JP)

(73) Assignee: Alps Green Devices Co., Ltd., Tokyo (JP)

( * ) Notice: Subject to any disclaimer, the term of this patent is extended or adjusted under 35 U.S.C. 154(b) by 0 days.

(21) Appl. No.: 13/942,579

(22) Filed: Jul. 15, 2013

(65) Prior Publication Data

US 2013/0300531 A1 Nov. 14, 2013

Related U.S. Application Data

(63) Continuation of application No. PCT/JP2011/080364, filed on Dec. 28, 2011.

(30) Foreign Application Priority Data

Jan. 17, 2011 (JP) ..... 2011-006770

(51) Int. Cl.

| | |
|---|---|
| ***H01F 27/24*** | (2006.01) |
| ***H01F 27/02*** | (2006.01) |
| ***H01F 5/00*** | (2006.01) |
| ***H01F 1/00*** | (2006.01) |
| ***B22F 1/00*** | (2006.01) |
| ***H01F 41/02*** | (2006.01) |
| ***C22C 38/00*** | (2006.01) |
| ***H01F 1/153*** | (2006.01) |
| ***C22C 45/02*** | (2006.01) |
| ***H01F 27/255*** | (2006.01) |
| ***C22C 33/02*** | (2006.01) |

(52) U.S. Cl.

CPC ..... *H01F 27/255* (2013.01); *B22F 1/0003* (2013.01); *H01F 41/0246* (2013.01); *C22C 38/00* (2013.01); *H01F 1/15308* (2013.01); *C22C 45/02* (2013.01); *C22C 33/0257* (2013.01)

USPC ..... 336/233; 336/83; 336/200; 148/300; 148/301; 148/302; 148/303; 148/304

(58) Field of Classification Search

USPC ..... 336/83, 200, 233

See application file for complete search history.

(56) References Cited

U.S. PATENT DOCUMENTS 7,132,019 B2 * 11/2006 Koshiba et al. ..... 148/304
7,815,753 B2 10/2010 Yi et al.

(Continued)

FOREIGN PATENT DOCUMENTS

JP 62277703 A * 12/1987
JP 63-117406 5/1988

(Continued)

OTHER PUBLICATIONS

Search Report dated Apr. 10, 2012 from International Application No. PCT/JP2011/080364.

*Primary Examiner* — Tsz Chan
(74) *Attorney, Agent, or Firm* — Beyer Law Group LLP

(57) ABSTRACT

An Fe-based amorphous alloy powder of the present invention has a composition represented by $(Fe_{100-a-b-c-x-y-z-t}Ni_a Sn_b Cr_c P_x C_y B_z Si_t)_{100-\alpha}M_\alpha$. In this composition, 0 at %≤a≤10 at %, 0 at %≤b≤3 at %, 0 at %≤c≤6 at %, 6.8 at %≤x≤10.8 at %, 2.2 at %≤y≤9.8 at %, 0 at %≤z≤4.2 at %, and 0 at %≤t≤3.9 at % hold, a metal element M is at least one selected from the group consisting of Ti, Al, Mn, Zr, Hf, V, Nb, Ta, Mo, and W, and the addition amount α of the metal element M satisfies 0.04 wt %≤α≤0.6 wt %. Accordingly, besides a decrease of a glass transition temperature (Tg), an excellent corrosion resistance and high magnetic characteristics can be obtained.

18 Claims, 15 Drawing Sheets

(56) References Cited

U.S. PATENT DOCUMENTS

| | | | | |
|---|---|---|---|---|
| 2006/0038651 | A1* | 2/2006 | Mizushima et al. | 336/83 |
| 2006/0170524 | A1* | 8/2006 | Fujiwara et al. | 336/83 |
| 2007/0040643 | A1* | 2/2007 | Inoue et al. | 336/213 |
| 2007/0175545 | A1 | 8/2007 | Urata et al. | |
| 2007/0258842 | A1 | 11/2007 | Lu et al. | |
| 2012/0092111 | A1 | 4/2012 | Tsuchiya et al. | |

FOREIGN PATENT DOCUMENTS

| | | | |
|---|---|---|---|
| JP | 2004-156134 | | 6/2004 |
| JP | 2009-54615 | | 3/2009 |
| JP | 2009-293099 | | 12/2009 |
| JP | 2009-299108 | | 12/2009 |
| WO | 2009/096382 | | 8/2009 |
| WO | WO 2009128524 | A1 * | 10/2009 |

* cited by examiner

FE-BASED AMORPHOUS ALLOY POWDER, DUST CORE USING THE SAME, AND COIL-EMBEDDED DUST CORE

CLAIM OF PRIORITY

This application is a Continuation of International Application No. PCT/JP2011/80364 filed on Dec. 28, 2011, which claims benefit of Japanese Patent Application No. 2011-006770 filed on Jan. 17, 2011. The entire contents of each application noted above are hereby incorporated by reference.

BACKGROUND OF THE INVENTION

1. Field of the Invention

The present invention relates to an Fe-based amorphous alloy powder applied, for example, to a dust core or a coil-embedded dust core, each of which is used for a transformer, a power supply choke coil, or the like.

2. Description of the Related Art

In concomitance with a recent trend toward a higher frequency and a larger current performance, a dust core and a coil-embedded dust core, which are applied to electronic components, are each required to have excellent direct-current superposing characteristics and a low core loss.

Incidentally, on a dust core having a desired shape formed from an Fe-based amorphous alloy powder with a binding material, in order to reduce a stress strain generated in powder formation of the Fe-based amorphous alloy powder and/or a stress strain generated in molding of the dust core, a heat treatment is performed after the core molding.

Since a heat treatment temperature to be actually applied to a core molded body cannot be set so high in consideration of a heat resistance of a coated wire, a binding material, and/or the like, a glass transition temperature (Tg) of the Fe-based amorphous alloy powder must be set to be low. In addition, a corrosion resistance must also be improved to obtain excellent magnetic characteristics.

As related technical documents, there are U.S. Patent Application Publication No. 2007/0175545, U.S. Pat. No. 7,815,753, Japanese Unexamined Patent Application Publication No. 2009-174034, U.S. Pat. No. 7,132,019, Japanese Unexamined Patent Application Publication Nos. 2009-54615, 2009-293099, and 63-117406, and U.S. Patent Application Publication No. 2007/0258842.

SUMMARY OF THE INVENTION

Accordingly, the present invention was made to solve the above related problems, and in particular, the present invention provides an Fe-based amorphous alloy powder which has a low glass transition temperature (Tg) and an excellent corrosion resistance and which is used for a dust core or a coil-embedded dust core, each having a high magnetic permeability and a low core loss.

The Fe-based amorphous alloy powder of the present invention has a composition represented by $(Fe_{100-a-b-c-x-y-z-t}Ni_aSn_bCr_cP_xC_yB_zSi_t)_{100-\alpha}M_\alpha$. In this composition, 0 at %≤a≤10 at %, 0 at %≤b≤3 at %, 0 at %≤c≤6 at %, 6.8 at %≤x≤10.8 at %, 2.2 at %≤y≤9.8 at %, 0 at %≤z≤4.2 at %, and 0 at %≤≤3.9 at % hold, a metal element M is at least one selected from the group consisting of Ti, Al, Mn, Zr, Hf, V, Nb, Ta, Mo, and W, and the addition amount α of the metal element M satisfies 0.04 wt %≤α≤0.6 wt %.

In order to obtain a low glass transition temperature (Tg), it is necessary to decrease the addition amounts of Si and B. On the other hand, since the corrosion resistance is liable to be degraded as the Si amount is decreased, in the present invention, by addition of a small amount of the highly active metal element M, a thin passivation layer can be stably formed at a powder surface, and the corrosion resistance is improved thereby, so that excellent magnetic characteristics can be obtained. In the present invention, by the addition of the metal element M, a particle shape of the powder can be made to have an aspect ratio larger than that of a spherical shape (aspect ratio: 1), and a magnetic permeability μ of the core can be effectively improved. Accordingly, an Fe-based amorphous alloy powder having, besides a low glass transition temperature (Tg), an excellent corrosion resistance, a high magnetic permeability, and a low core loss can be obtained.

In the present invention, it is preferable that the addition amount z of B satisfy 0 at %≤z≤2 at %, the addition amount t of Si satisfy 0 at %≤t≤1 at %, and the sum of the addition amount z of B and the addition amount t of Si satisfy 0 at %≤z+t≤2 at %. Accordingly, the glass transition temperature (Tg) can be more effectively decreased.

In addition, in the present invention, when both B and Si are added, the addition amount of z of B is preferably larger than the addition amount t of Si. Accordingly, the glass transition temperature (Tg) can be effectively decreased.

In addition, in the present invention, the addition amount α of the metal element M preferably satisfies 0.1 wt %≤α≤0.6 wt %. Accordingly, a high magnetic permeability μ can be stably obtained.

In addition, in the present invention, the metal element M preferably at least includes Ti. Accordingly, a thin passivation layer can be stably and effectively formed at the powder surface, and excellent magnetic characteristics can be obtained.

Alternatively, in the present invention, the metal element M may also include Ti, Al, and Mn.

In addition, in the present invention, only one of Ni and Sn is preferably added.

In addition, in the present invention, the addition amount a of Ni is preferably in a range of 0 at %≤a≤6 at %. Accordingly, a high reduced vitrification temperature (Tg/Tm) and Tx/Tm can be stably obtained, and an amorphous forming ability can be enhanced.

In addition, in the present invention, the addition amount b of Sn is preferably in a range of 0 at %≤b≤2 at %. When the Sn amount is increased, since an $O_2$ concentration of the powder is increased, and the corrosion resistance is degraded, in order to suppress the degradation in corrosion resistance and to enhance the amorphous forming ability, the addition amount b of Sn is preferably set to 2 at % or less.

In addition, in the present invention, the addition amount c of Cr is preferably in a range of 0 at %≤c≤2 at %. Accordingly, the glass transition temperature (Tg) can be stably and effectively decreased.

In addition, in the present invention, the addition amount x of P is preferably in a range of 8.8 at %≤x≤10.8 at %. Accordingly, a melting point (Tm) can be decreased, and although Tg is decreased, the reduced vitrification temperature (Tg/Tm) can be increased, and the amorphous forming ability can be enhanced.

In addition, in the present invention, it is preferable to satisfy 0 at %≤a≤6 at %, 0 at %≤b≤2 at %, 0 at %≤c≤2 at %, 8.8 at %≤x≤10.8 at %, 2.2 at %≤y≤9.8 at %, 0 at %≤z≤2 at %, 0 at %≤t≤1 at %, 0 at %≤z+t≤2 at %, and 0.1 wt %≤α≤0.6 wt %.

In addition, in the present invention, the aspect ratio of the powder is preferably more than 1 to 1.4. Accordingly, the magnetic permeability μ of the core can be increased.

In addition, in the present invention, the aspect ratio of the powder is preferably 1.2 to 1.4. Accordingly, the magnetic permeability μ of the core can be stably increased.

In addition, in the present invention, the concentration of the metal element M is preferably high in a powder surface layer as compared to that inside the powder. In the present invention, by addition of a small amount of the highly active metal element M, the metal element M is aggregated in the powder surface layer, and hence a passivation layer can be formed.

In addition, in the present invention, when Si is contained as the composition element, the concentration of the metal element M in the powder surface layer is preferably high as compared to that of Si. When the addition amount α of the metal element M is zero or smaller than that of the present invention, the Si concentration becomes high at the powder surface. In this case, the thickness of the passivation layer tends to be larger than that of the present invention. On the other hand, in the present invention, when the addition amount of Si is decreased to 3.9 at % or less (addition amount in Fe—Ni—Sn—Cr—P—C—B—Si), and 0.04 to 0.6 wt % of the highly active metal element M is added in the alloy powder, the metal element M can be aggregated at the powder surface to form a thin passivation layer in combination with Si and O, and hence excellent magnetic characteristics can be obtained.

In addition, a dust core of the present invention is formed by solidification molding of particles of the above Fe-based amorphous alloy powder with a binding material.

In the present invention, in the dust core described above, since an optimum heat treatment temperature of the Fe-based amorphous alloy powder can be decreased, a stress strain thereof can be appropriately reduced even at a heat treatment temperature lower than a heat resistant temperature of the binding material, the magnetic permeability μ of the dust core can be increased, and the core loss can also be reduced; hence, a desired high inductance can be obtained at a small number of turns, and heat generation and a copper loss of the dust core can be suppressed.

In addition, a coil-embedded dust core of the present invention includes a dust core formed by solidification molding of particles of the above Fe-based amorphous alloy powder with a binding material and a coil covered with the above dust core. In the present invention, the optimum heat treatment temperature of the core can be decreased, and the core loss can be reduced. In this case, as the coil, an edgewise coil is preferably used. When the edgewise coil is used, since a coil formed of a coil conductor having a large cross-sectional area can be used, a direct-current resistance RDc can be reduced, and heat generation and a copper loss can be suppressed.

DESCRIPTION OF THE PREFERRED EMBODIMENTS

Figure 1:
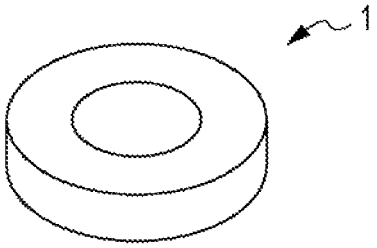
FIG. 1 is a perspective view of a dust core.

An Fe-based amorphous alloy powder according to this embodiment has a composition represented by $(Fe_{100-a-b-c-x-y-z-t}Ni_aSn_bCr_cP_xC_yB_zSi_t)_{100-\alpha}M_\alpha$. In this composition, 0 at %≤a≤10 at %, 0 at %≤b≤3 at %, 0 at %≤c≤6 at %, 6.8 at %≤x≤10.8 at %, 2.2 at %≤y≤9.8 at %, 0 at %≤z≤4.2 at %, and 0 at %≤t≤3.9 at % hold, a metal element M is at least one selected from the group consisting of Ti, Al, Mn, Zr, Hf, V, Nb, Ta, Mo, and W, and the addition amount a of the metal element M satisfies 0.04 wt %≤α≤0.6 wt %.

As described above, the Fe-based amorphous alloy powder of this embodiment is a soft magnetic alloy containing Fe as a primary component, Ni, Sn, Cr, P, C, B, Si (however, the addition of Ni, Sn, Cr, B, and Si is arbitrary), and the metal element M.

In addition, in the Fe-based amorphous alloy powder of this embodiment, in order to further increase a saturation magnetic flux density and/or to adjust a magnetostriction, a mixed-phase texture of an amorphous phase functioning as a primary phase and an α-Fe crystalline phase may also be formed by a heat treatment performed in core molding. The α-Fe crystalline phase has a bcc structure.

In this embodiment, it is intended to decrease a glass transition temperature (Tg) by decreasing the addition amounts of B and Si as small as possible, and in addition, a corrosion resistance which is degraded by the decrease in addition amount of Si is improved by the addition of a small amount of the highly active metal element M.

Hereinafter, the addition amount of each composition element in the Fe—Ni—Sn—Cr—P—C—B—Si will be described.

The addition amount of Fe contained in the Fe-based amorphous alloy powder of this embodiment is represented, in the above formula, by (100-a-b-c-x-y-z-t) in the Fe—Ni—Sn—Cr—P—C—B—Si, and in the experiments which will be described later, the addition amount is in a range of approximately 65.9 to 77.4 at % in the Fe—Ni—Sn—Cr—P—C—B—Si. Since the addition amount of Fe is high as described above, high magnetization can be obtained.

The addition amount a of Ni contained in the Fe—Ni—Sn—Cr—P—C—B—Si is defined in a range of 0 at % al 0 at %. By the addition of Ni, the glass transition temperature (Tg) can be decreased, and in addition, a reduced vitrification temperature (Tg/Tm) and Tx/Tm can be maintained at a high value. In this embodiment, Tm indicates the melting point, and Tx indicates a crystallization starting temperature. Even when the addition amount a of Ni is increased to approximately 10 at %, an amorphous substance can be obtained. However, when the addition amount a of Ni is more than 6 at %, the reduced vitrification temperature (Tg/Tm) and Tx/Tm are decreased, and the amorphous forming ability is degraded; hence, in this embodiment, the addition amount a of Ni is preferably in a range of 0 at %≤a≤6 at %. In addition, when the addition amount a of Ni is set in a range of 4 at %≤a≤6 at %, a low glass transition temperature (Tg), a high reduced vitrification temperature (Tg/Tm), and high Tx/Tm can be stably obtained.

The addition amount b of Sn contained in the Fe—Ni—Sn—Cr—P—C—B—Si is defined in a range of 0 at %≤b≤3 at %. Even when the addition amount b of Sn is increased to approximately 3 at %, an amorphous substance can be obtained. However, by the addition of Sn, an oxygen concentration in the alloy powder is increased, and as a result, the corrosion resistance is liable to be degraded. Hence, the addition amount of Sn is decreased to the minimum necessary. In addition, when the addition amount b of Sn is set to approximately 3 at %, since Tx/Tm is remarkably decreased, and the amorphous forming ability is degraded, a preferable range of the addition amount b of Sn is set to 0 at %≤b≤2 at %. Alternatively, the addition amount b of Sn is more preferably set in a range of 1 at %≤b≤2 at % since high Tx/Tm can be secured.

Incidentally, in this embodiment, it is preferable that neither Ni nor Sn be added or only one of Ni and Sn be added in the Fe-based amorphous alloy powder. Accordingly, besides a low glass transition temperature (Tg) and a high reduced vitrification temperature (Tg/Tm), an increase in magnetization and an improvement in corrosion resistance can be more effectively achieved.

The addition amount c of Cr contained in the Fe—Ni—Sn—Cr—P—C—B—Si is defined in a range of 0 at %≤c≤6 at %. Cr can promote the formation of a passivation layer at a powder surface and can improve the corrosion resistance of the Fe-based amorphous alloy powder. For example, corrosion areas can be prevented from being generated when a molten alloy is in direct contact with water in the formation of the Fe-based amorphous alloy powder using a water atomizing method and can be further prevented from being generated in a step of drying the Fe-based amorphous alloy powder performed after the water atomizing. On the other hand, by the addition of Cr, since the glass transition temperature (Tg) is increased, and saturation magnetization Is is decreased, it is effective to decrease the addition amount c of Cr to the minimum necessary. In particular, the addition amount c of Cr is preferably set in a range of 0 at %≤c≤2 at % since the glass transition temperature (Tg) can be maintained low.

Furthermore, the addition amount c of Cr is more preferably controlled in a range of 1 at %≤c≤2 at %. Besides a preferable corrosion resistance, the glass transition temperature (Tg) can be maintained low, and the magnetization can also be maintained high.

The addition amount x of P contained in the Fe—Ni—Sn—Cr—P—C—B—Si is defined in a range of 6.8 at %≤x≤10.8 at %. In addition, the addition amount y of C contained in the Fe—Ni—Sn—Cr—P—C—B—Si is defined in a range of 2.2 at %≤y≤9.8 at %. Since the addition amounts of P and C are defined in the above ranges, an amorphous substance can be obtained.

In addition, in this embodiment, although the glass transition temperature (Tg) of the Fe-based amorphous alloy powder is decreased, and at the same time, the reduced vitrification temperature (Tg/Tm) used as an index of the amorphous forming ability is increased, because of the decrease in glass transition temperature (Tg), it is necessary to decrease the melting point (Tm) in order to increase the reduced vitrification temperature (Tg/Tm).

In this embodiment, in particular, when the addition amount x of P is controlled in a range of 8.8 at %≤x≤10.8 at %, the melting point (Tm) can be effectively decreased, and hence, the reduced vitrification temperature (Tg/Tm) can be increased.

Among half metals, in general, P has been known as an element that is liable to reduce the magnetization, and in order to obtain high magnetization, the addition amount is necessarily decreased to a certain extent. In addition, when the addition amount x of P is set to 10.8 at %, since this composition becomes similar to an eutectic composition of an Fe—P—C ternary alloy ($Fe_{79.4}P_{10.8}C_{9.8}$), the addition of more than 10.8 at % of P causes an increase in melting point (Tm). Hence, the upper limit of the addition amount of P is preferably set to 10.8 at %. On the other hand, in order to effectively decrease the melting point (Tm) and to increase the reduced vitrification temperature (Tg/Tm) as described above, 8.8 at % or more of P is preferably added.

In addition, the addition amount y of C is preferably controlled in a range of 5.8 at %≤y≤8.8 at %. By this control, in an effective manner, the melting point (Tm) can be decreased, the reduced vitrification temperature (Tg/Tm) can be increased, and the magnetization can be maintained at a high value.

The addition amount z of B contained in the Fe—Ni—Sn—Cr—P—C—B—Si is defined in a range of 0 at %≤z≤4.2 at %. In addition, the addition amount t of Si contained in the Fe—Ni—Sn—Cr—P—C—B—Si is defined in a range of 0 at %≤t≤3.9 at %.

Although being effective to improve the amorphous forming ability, the addition of Si and B is liable to increase the glass transition temperature (Tg), and hence in this embodiment, in order to decrease the glass transition temperature (Tg) as low as possible, the addition amounts of Si, B, and ($Si^+$ B) are each decreased to the minimum necessary. In particular, the glass transition temperature (Tg) of the Fe-based amorphous alloy powder is set to 740K (Kelvin) or less.

In addition, in this embodiment, when the addition amount z of B is set in a range of 0 at %≤z≤2 at %, the addition amount t of Si is set in a range of 0 at %≤t≤1 at %, and further (the addition amount z of B+ the addition amount t of Si) is set in a range of 0 at %≤z+t≤2 at %, the glass transition temperature (Tg) can be controlled to 710K or less.

In an embodiment in which both B and Si are added in the Fe-based amorphous alloy powder, in the composition ranges described above, the addition amount z of B is preferably larger than the addition amount t of Si. Accordingly, a low glass transition temperature (Tg) can be stably obtained.

As described above, in this embodiment, although the addition amount of Si is decreased as small as possible to promote the decrease in Tg, a corrosion resistance degraded by the above addition is improved by the addition of a small amount of the metal element M.

The metal element M is at least one element selected from the group consisting of Ti, Al, Mn, Zr, Hf, V, Nb, Ta, Mo, and W.

The addition amount α of the metal element M is shown in a composition formula $(Fe—Ni—Sn—Cr—P—C—B—Si)_{100-\alpha}M_{\alpha}$ and is preferably in a range of 0.04 to 0.6 wt %.

Since a small amount of the highly active metal element M is added, before powder particles are formed into spheres in the formation by a water atomizing method, a passivation layer is formed at the powder surface, and hence, particles having an aspect ratio larger than that of a sphere (aspect ratio=1) are solidified. Since the powder can be formed into particles each having a shape different from that of a sphere and an aspect ratio slightly larger than that thereof, a magnetic permeability μ of the core can be increased. In particular, in this embodiment, the aspect ratio of the powder can be set in a range of more than 1 to 1.4 and preferably in a range of 1.1 to 1.4.

Figure 3:
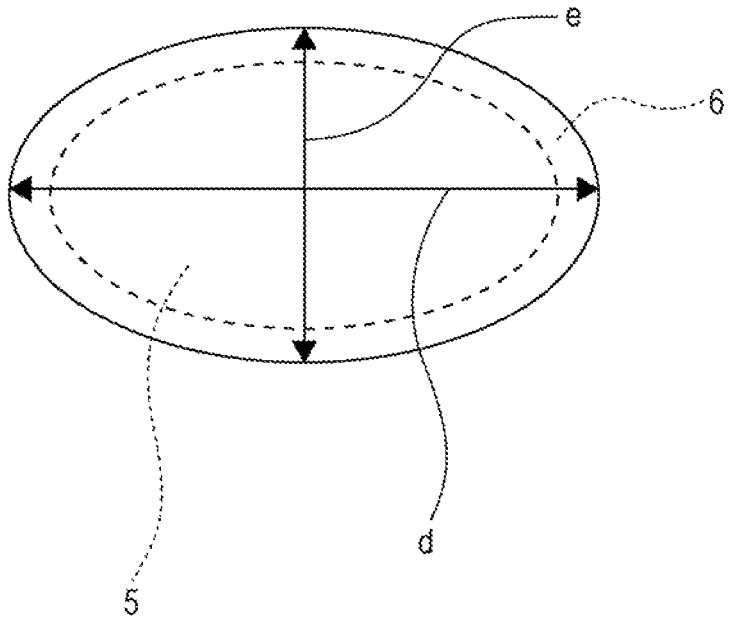
FIG. 3 is an imaginary view of a cross section of an Fe-based amorphous alloy powder according to an embodiment.

The aspect ratio in this embodiment indicates a ratio (d/e) of a major axis d of the powder shown in FIG. 3 to a minor axis e thereof. For example, the aspect ratio (d/e) is obtained from a two-dimensional projection view of the powder. The major axis d indicates the longest portion, and the minor axis e indicates the shortest portion perpendicular to the major axis d.

When the aspect ratio is excessively increased, the density of the Fe-based amorphous alloy powder in the core is decreased, and as a result, the magnetic permeability μ is decreased; hence, in this embodiment, in accordance with the experimental results which will be described later, the aspect ratio is set in a range of more than 1 (preferably 1.1 or more) to 1.4. Accordingly, the magnetic permeability μ of the core at 100 MHz can be set, for example, to 60 or more.

In addition, the addition amount α of the metal element M is preferably in a range of 0.1 to 0.6 wt %. The aspect ratio of the powder can be set in a range of 1.2 to 1.4, and as a result, a magnetic permeability μ of 60 or more can be stably obtained at 100 MHz.

The metal element M preferably at least includes Ti. A thin passivation film can be effectively and stably formed at the powder surface, the aspect ratio of the powder can be appropriately controlled in a range of more than 1 to 1.4, and excellent magnetic characteristics can be obtained. Alternatively, the metal element M may also include Ti, Al, and Mn.

In this embodiment, the concentration of the metal element M is higher in a powder surface layer 6 than that in an inside 5 of the powder shown in FIG. 3. In this embodiment, since a small amount of the highly active metal element M is added, the metal element M is aggregated in the powder surface layer 6, and hence, the passivation layer can be formed in combination with Si and O.

In this embodiment, although the addition amount α of the metal element M is set in a range of 0.04 to 0.6 wt %, it is found by the experiments which will be described later that when the addition amount of the metal element M is set to zero or less than 0.04 wt %, the concentration of Si in the powder surface layer 6 is higher than that of the metal element M. In this case, the thickness of the passivation layer is liable to be larger than that of this embodiment. On the other hand, in this embodiment, when the addition amount of Si (in the Fe—Ni—Sn—Cr—P—C—B—Si) is set to 3.9 at % or less, and the highly active metal element M is added in an amount in a range of 0.04 to 0.6 wt %, a larger amount of the metal element M can be aggregated in the powder surface layer 6 than that of Si. Although the metal element M forms a passivation layer in the powder surface layer 6 in combination with Si and O, in this embodiment, compared to the case in which the addition amount α of the metal element M is set to less than 0.04 wt %, the passivation layer can be formed thin, and excellent magnetic characteristics can be obtained.

In addition, the composition of the Fe-based amorphous alloy powder of this embodiment can be measured by an inductively coupled plasma mass spectrometer (ICP-MS) or the like.

In this embodiment, after an Fe-based amorphous alloy represented by the above composition formula is weighed and melted, the molten alloy is dispersed by a water atomizing method or the like for rapid solidification, so that the Fe-based amorphous alloy powder is obtained. In this embodiment, since a thin passivation layer can be formed in the powder surface layer 6 of the Fe-based amorphous alloy powder, characteristic degradation of the powder and that of a dust core formed therefrom by powder compaction molding can be suppressed, the characteristic degradation being caused by metal components which are partially corroded in a powder manufacturing step.

Figure 2A:
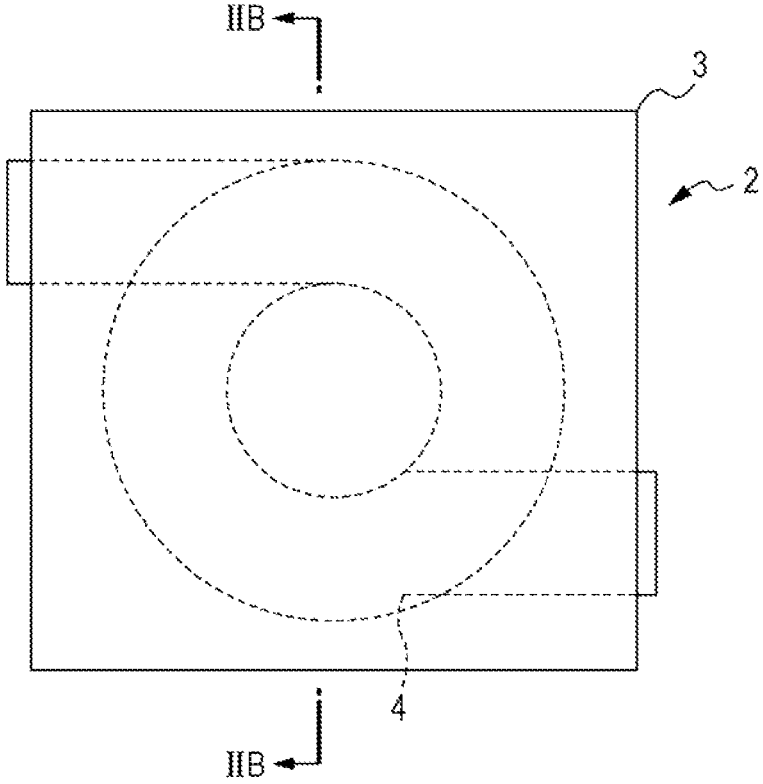
FIG. 2A is a plan view of a coil-embedded dust core.
Figure 2B:
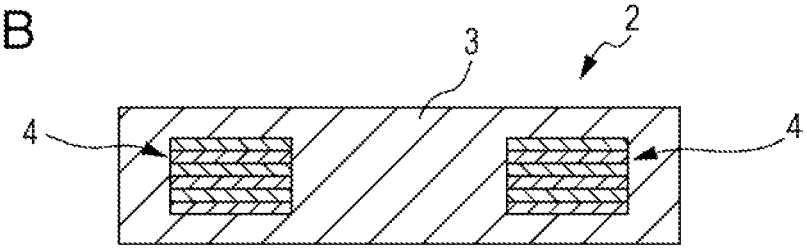
FIG. 2B is a vertical cross-sectional view of the coil-embedded dust core taken along the IIB-IIB line and viewed in the arrow direction shown in FIG. 2A.

In addition, the Fe-based amorphous alloy powder of this embodiment is used for a ring-shaped dust core 1 shown in FIG. 1 and a coil-embedded dust core 2 shown in FIGS. 2A and 2B, each of which is formed, for example, by solidification molding with a binding material or the like.

The coil-embedded dust core (inductor element) 2 shown in FIGS. 2A and 2B is formed of a dust core 3 and a coil 4 covered with the dust core 3. Many particles of the Fe-based amorphous alloy powder are present in the core, and the particles of the Fe-based amorphous alloy powder are insulated from each other with the binding material provided therebetween.

In addition, as the binding material, for example, there may be mentioned a liquid or a powder resin or a rubber, such as an epoxy resin, a silicone resin, a silicone rubber, a phenol resin, a urea resin, a melamine resin, a poly(vinyl alcohol) (PVA), or an acrylic resin; water glass ($Na_2O$—$SiO_2$); an oxide glass powder ($Na_2O$—$B_2O_3$—$SiO_2$, PbO—$B_2O_3$—$SiO_2$, PbO—$B_aO$—$SiO_2$, $Na_2O$—$B_2O_3$—ZnO, CaO—$B_aO$—$SiO_2$, $Al_2O_3$—$B_2O_3$—$SiO_2$, or $B_2O_3$—$SiO_2$); and a glassy material (containing $SiO_2$, $Al_2O_3$, $ZrO_2$, $TiO_2$, or the like as a primary component) produced by a sol-gel method.

In addition, as a lubricant agent, for example, zinc stearate or aluminum stearate may be used. A mixing ratio of the binding material is 5 mass % or less, and an addition amount of the lubricant agent is approximately 0.1 to 1 mass %.

After the dust core is formed by press molding, although a heat treatment is performed in order to reduce a stress strain of the Fe-based amorphous alloy powder, the glass transition temperature (Tg) thereof can be decreased in this embodiment, and hence, an optimum heat treatment temperature of the core can be decreased as compared to that in the past. In this embodiment, the "optimum heat treatment temperature" indicates a heat treatment temperature for a core molded body that can effectively reduce the stress strain of the Fe-based amorphous alloy powder and can minimize a core loss. For example, in an inert gas atmosphere containing a $N_2$ gas, an Ar gas, or the like, after a temperature rise rate is set to 40° C./min, the temperature is increased to a predetermined heat treatment temperature and is then maintained for 1 hour, and a heat treatment temperature at which a core loss (W) can be minimized is regarded as the optimum heat treatment temperature.

A heat treatment temperature Ti applied after the dust core molding is set to be equal to or lower than an optimum heat treatment temperature T2 in consideration of a heat resistance and the like of the resin. In this embodiment, the heat treatment temperature T1 can be controlled to be approximately 300° C. to 400° C. In addition, in this embodiment, since the optimum heat treatment temperature T2 can be set lower than that in the past, (the optimum heat treatment temperature T2—the heat treatment temperature T1 after core molding) can be decreased as compared to that in the past. Hence, in this embodiment, by a heat treatment at the heat treatment temperature T1 performed after the core molding, the stress strain of the Fe-based amorphous alloy powder can also be effectively reduced as compared to that in the past, and in addition, since the Fe-based amorphous alloy powder in this embodiment maintains high magnetization, a desired inductance can be secured, and the core loss (W) can also be reduced, so that a high power supply efficiency (η) can be obtained when mounting is performed in a power supply.

In particular, in this embodiment, in the Fe-based amorphous alloy powder, the glass transition temperature (Tg) can be set to 740K or less and preferably 710K or less. In addition, the reduced vitrification temperature (Tg/Tm) can be set to 0.52 or more, preferably 0.54 or more, and more preferably 0.56 or more. In addition, the saturation magnetization Is can be set to 1.0 T or more.

In addition, as core characteristics, the optimum heat treatment temperature can be set to 693.15K (420° C.) or less and preferably 673.15K (400° C.) or less. In addition, the core loss (W) can be set to 90 ($kW/m^3$) or less and preferably 60 ($kW/m^3$) or less.

In this embodiment, as shown in the coil-embedded dust core 2 of FIG. 2B, an edgewise coil may be used for the coil 4. The edgewise coil is a coil formed by winding a rectangular wire in a longitudinal direction so that a shorter side of the wire is used to form an inner diameter surface of the coil.

According to this embodiment, since the optimum heat treatment temperature of the Fe-based amorphous alloy powder can be decreased, the stress strain can be appropriately reduced by a heat treatment temperature lower than the heat resistant temperature of the binding material, and since the magnetic permeability μ of the dust core 3 can be increased, and the core loss can be reduced, a desired high inductance L can be obtained with a small number of turns. As described above, in this embodiment, since an edgewise coil formed of a conductor having a large cross-sectional area in each turn can be used for the coil 4, the direct-current resistance Rdc can be reduced, and the heat generation and the copper loss can be suppressed.

EXAMPLES

Experiment of Powder Surface Analysis

An Fe-based amorphous alloy powder represented by $(Fe_{77.4}Cr_2P_{8.8}C_{8.8}B_2Si_1)_{100-\alpha}Ti_\alpha$ was manufactured by a water atomizing method. In addition, the addition amount of each element in the Fe—Cr—P—C—B—Si was represented by at %. A molten metal temperature (temperature of molten alloy) at which the powder was obtained was 1,500° C., and an ejection pressure of water was 80 MPa.

In addition, the above atomizing conditions of this experiment were not changed in the experiments which will be described later.

In the experiment, an Fe-based amorphous alloy powder in which the addition amount α of Ti was 0.035 wt % (Comparative Example) and an Fe-based amorphous alloy powder in which the addition amount α of Ti was 0.25 wt % (Example) were manufactured.

Figure 4A:
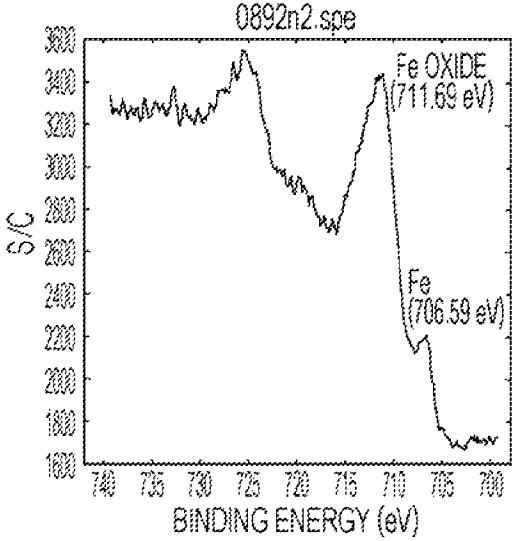
FIGS. 4A to 4C show XPS analytical results of an Fe-based amorphous alloy powder of a comparative example (Ti amount: 0.035 wt %)
Figure 4B:
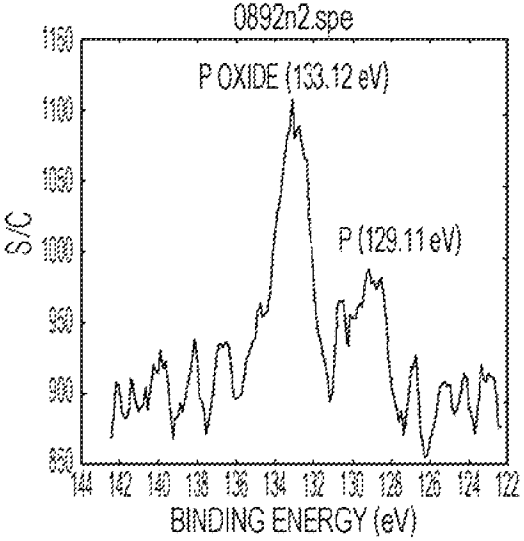
Figure 4C:
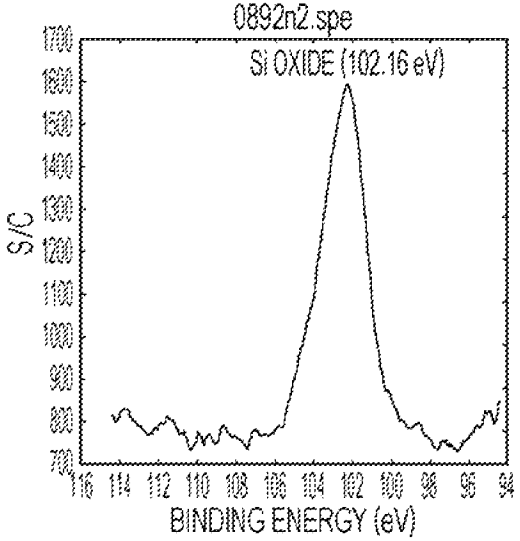

Surface analysis results by an x-ray photoelectron spectrometer (XPS) are shown in FIGS. 4A to 4C and 5A to 5D. FIG. 4A to 4C show experimental results of the Fe-based amorphous alloy powder of Comparative Example, and FIG. 5A to 5D show experimental results of the Fe-based amorphous alloy powder of Example.

As shown in FIGS. 4A to 4C and FIGS. 5A to 5C, it was found that oxides of Fe, P and Si were formed at a powder surface.

Figure 5A:
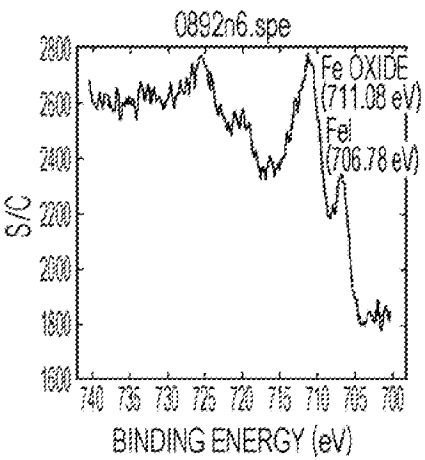
FIGS. 5A to 5D show XPS analytical results of an Fe-based amorphous alloy powder of an example (Ti amount: 0.25 wt %)
Figure 5B:
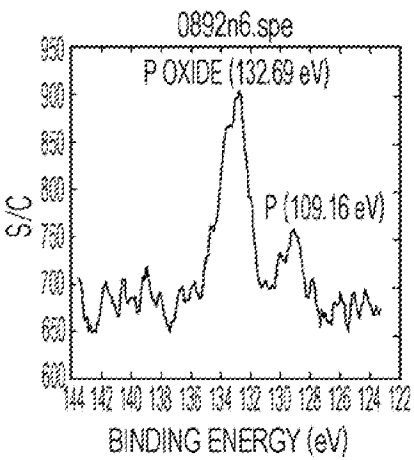
Figure 5C:
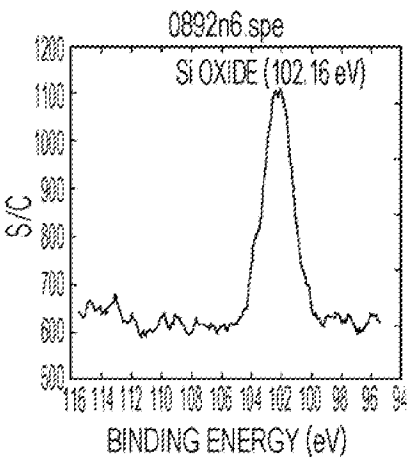
Figure 5D:
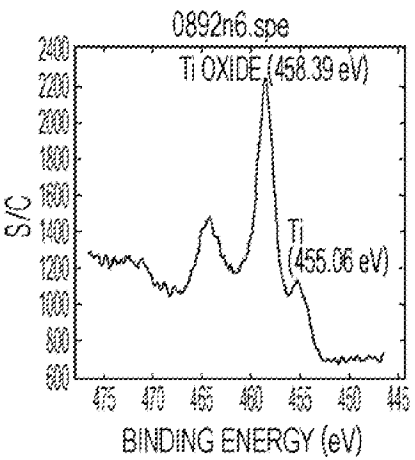

In addition, in Comparative Example shown in FIGS. 4A to 4C, since the addition amount α of Ti was too small, the state of Ti at the powder surface could not be analyzed. On the other hand, as shown in FIG. 5D, in Example, it was found that an oxide of Ti was formed at the powder surface.

Figure 6:
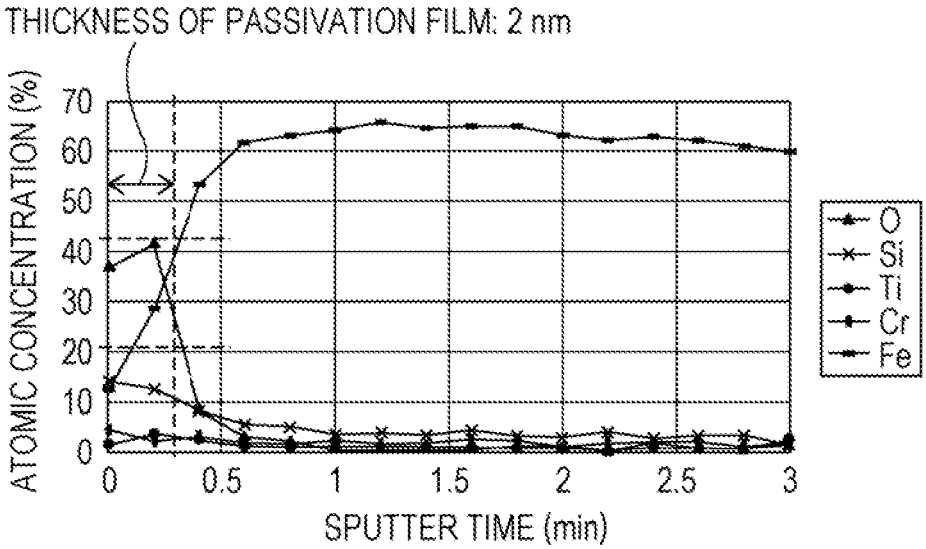
FIG. 6 is a depth profile of the Fe-based amorphous alloy powder of the comparative example (Ti amount: 0.035 wt %) measured by an Auger electron spectroscopic (AES) method.
Figure 7:
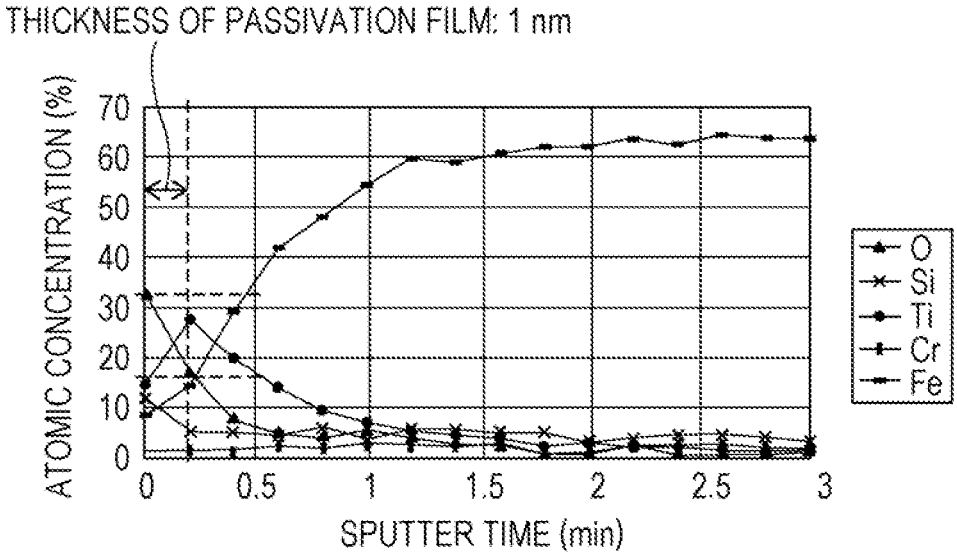
FIG. 7 is a depth profile of the Fe-based amorphous alloy powder of the example (Ti amount: 0.25 wt %) measured by an AES method.

Next, FIG. 6 shows a depth profile of the Fe-based amorphous alloy powder of Comparative Example measured by an Auger electron spectroscopic (AES) method, and FIG. 7 shows a depth profile of the Fe-based amorphous alloy powder of Example measured by an AES method. In each graph, a data shown at the most left side of the vertical axis indicates an analytical result obtained at the powder surface, and a data shown at the right side indicates an analytical result obtained at a position located toward the inside of the powder (in a direction toward the center of the powder).

As shown in Comparative Example of FIG. 6, it was found that the concentration of Ti was not changed so much from the powder surface to the inside of the powder and was low as a whole. On the other hand, it was found that the concentration of Si was higher than that of Ti at a surface side of the powder. In addition, it was found that the concentration of Si gradually decreased toward the inside of the powder, and that the difference from the Ti concentration became small. It was found that O is aggregated at the surface side of the powder, and that the concentration was very small inside the powder. In addition, it was found that the concentration of Fe gradually increased from the powder surface to the inside of the powder and became approximately constant from a certain depth position. It was found that the concentration of Cr was not changed so much from the powder surface to the inside of the powder.

On the other hand, according to Example shown in FIG. 7, it was found that the concentration of Ti was high at the surface side of the powder and gradually decreased toward the inside of the powder. At the surface side of the powder, the concentration of Ti was higher than that of Si, and the concentration profile result was different from that of Comparative Example shown in FIG. 6. In addition, O was aggregated at the surface side of the powder, and this behavior shown in FIG. 7 was similar to that shown in FIG. 6; however, since a depth position of Example shown in FIG. 7 at which the maximum concentration of O decreased to one half was closer to the powder surface than that of Comparative Example shown in FIG. 6, it was found that the thickness of the passivation layer of Example shown in FIG. 7 could be formed smaller than that of Comparative Example shown in FIG. 6. In addition, it was found that the change in concentration of Fe of Example shown in FIG. 7 gradually increased from the powder surface to the inside of the powder as compared to that of Comparative Example shown in FIG. 6. It was found that the concentration of Cr of Example shown in FIG. 7 was not different so much from that of Comparative Example shown in FIG. 6.

Experiment on Relationship of Addition Amount of Ti with Aspect Ratio and Magnetic Permeability An Fe-based amorphous alloy powder represented by $(Fe_{71.4}Ni_6Cr_2P_{10.8}C_{7.8}B_2)_{100-\alpha}Ti_\alpha$ was manufactured by a water atomizing method. In addition, the addition amount of each element in the Fe—Ni—Cr—P—C—B was represented by at %. In addition, the addition amount α of Ti of each Fe-based amorphous alloy powder was set to 0.035 wt %, 0.049 wt %, 0.094 wt %, 0.268 wt %, 0.442 wt %, 0.595 wt %, or 0.805 wt %.

Figure 8:
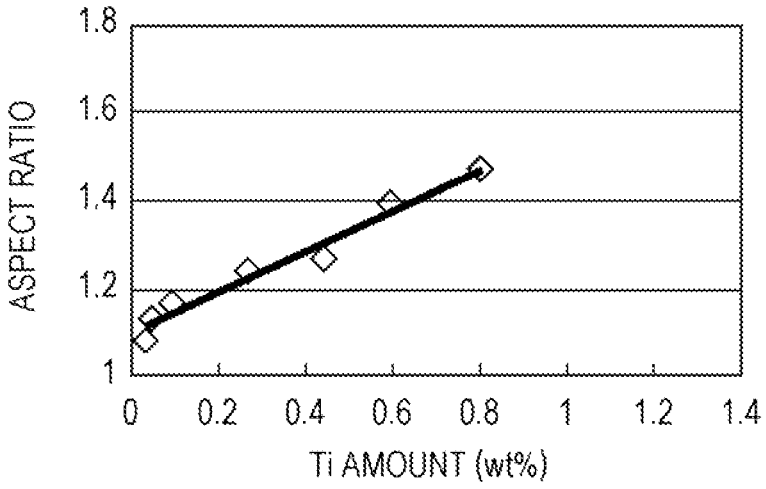
FIG. 8 is a graph showing the relationship between a Ti addition amount in an Fe-based amorphous alloy powder and an aspect ratio thereof.

As shown in FIG. 8, it was found that when the addition amount a of Ti was increased, the aspect ratio of the powder was gradually increased. In this case, the aspect ratio is represented by the ratio (d/e) of the major axis d to the minor axis e in the two-dimensional projection view of the powder shown in FIG. 3. An aspect ratio of 1 indicates a sphere. As described above, it was found that by the addition of highly active Ti, when the formation was performed using a water atomizing method, before the powder was formed into spherical particles, a thin passivation layer could be formed at the powder surface as shown in FIG. 7, and particles having an irregular shape with an aspect ratio larger than that of a sphere (aspect ratio: 1) could be formed. In addition, the particular aspect ratios obtained in FIG. 8 were 1.08, 1.13, 1.16, 1.24, 1.27, 1.39, and 1.47 in the ascending order of the addition amount α of Ti.

Next, in the experiment, after 3 mass % of a resin (acrylic resin) and 0.3 mass % of a lubricant agent (zinc stearate) were mixed together with each of the Fe-based amorphous alloy powders having different addition amounts α of Ti, a core molded body in a toroidal shape having an outside diameter of 20 mm, an inside diameter of 12 mm, and a height of 6.8 mm was formed at a press pressure of 600 MPa and was further processed in a $N_2$ gas atmosphere under conditions in which the temperature rise rate was set to 0.67K/sec (40° C./min), the heat treatment temperature was set in a range of 300° C. to 400° C., and a holding time was set to 1 hour, so that a dust core was formed.

In addition, the core formation conditions of this experiment described above were not changed in the experiments which will be described later.

Figure 9:
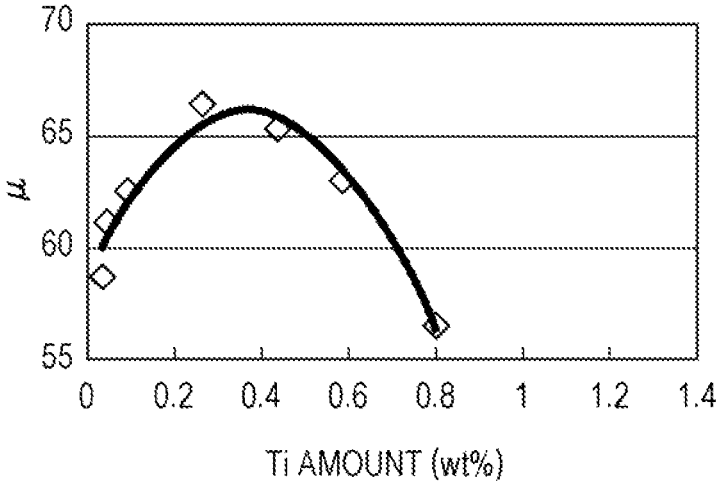
FIG. 9 is a graph showing the relationship between the Ti addition amount in the Fe-based amorphous alloy powder and a magnetic permeability μ of a core.

In addition, the relationship of the addition amount α of Ti with the magnetic permeability μ of the core and a saturation magnetic flux density Bs was investigated. The magnetic permeability μ was measured at a frequency of 100 kHz using an impedance analyzer. As shown in FIG. 9, it was found that when the addition amount α of Ti was increased to approximately 0.6 wt %, although a high magnetic permeability μ of approximately 60 or more could be secured, when the addition amount α of Ti was further increased, the magnetic permeability μ was decreased to less than 60.

Figure 10:
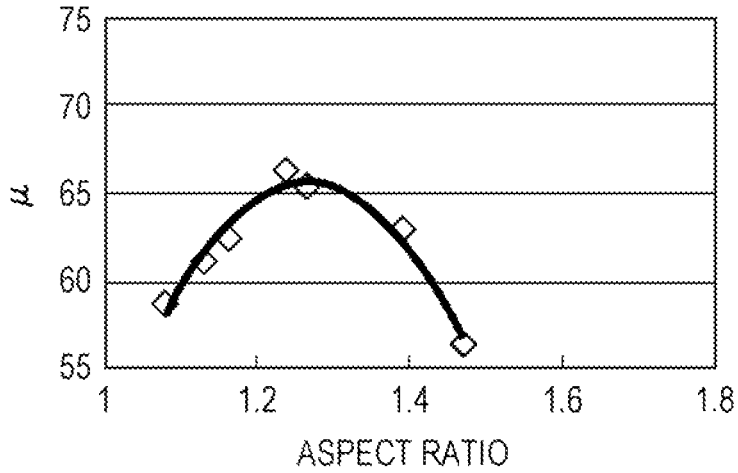
FIG. 10 is a graph showing the relationship between the aspect ratio of the Fe-based amorphous alloy powder shown in FIG. 8 and the magnetic permeability μ of the core shown in FIG. 9.

As shown in FIG. 10, it was found that although the magnetic permeability μ could be gradually increased when the aspect ratio of the powder was more than 1 to approximately 1.3, when the aspect ratio was more than approximately 1.3, the magnetic permeability μ was gradually decreased, and when the aspect ratio was more than 1.4, by a decrease in core density, the magnetic permeability μ was rapidly decreased to less than 60.

Figure 11:
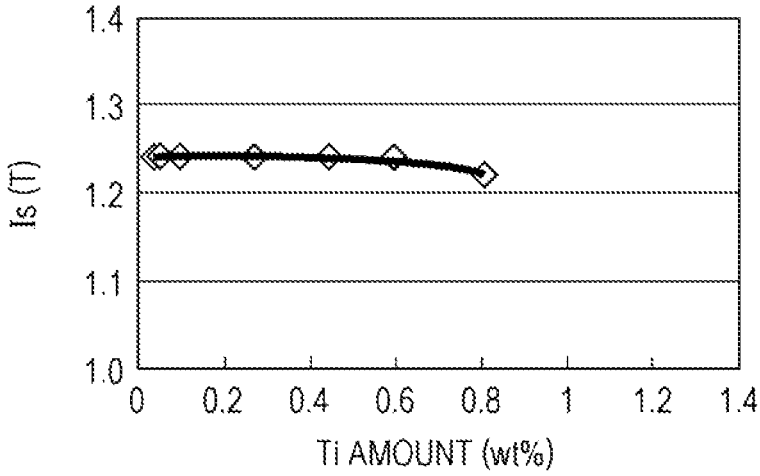
FIG. 11 is a graph showing the relationship between the Ti addition amount in the Fe-based amorphous alloy powder and saturation magnetization Is of the alloy.

In addition, as shown in FIG. 11, a decrease in saturation magnetization Is caused by the addition amount of Ti was not observed.

By the experiments shown in FIGS. 4 to 11, the addition amount α of Ti was set in a range of 0.04 to 0.6 wt %. In addition, the aspect ratio of the powder was set in a range of more than 1 to 1.4 and preferably in a range of 1.1 to 1.4. Accordingly, a magnetic permeability μ of 60 or more could be obtained.

In addition, a preferable range of the addition amount α of Ti was set to 0.1 to 0.6 wt %. In addition, a preferable aspect ratio of the powder was set to 1.2 to 1.4. Accordingly, a high magnetic permeability μ of the core can be stably obtained.

Experiment on Applicable Range of Glass Transition Temperature (Tg)

Fe-based amorphous alloys of Nos. 1 to 8 shown in the following Table 1 were each manufactured to have a ribbon shape by a liquid quenching method, and a dust core was further formed using a powder of each Fe-based amorphous alloy.

TABLE 1

| | | | Ti ADDITION | | HEAT STABILITY OF ALLOY | | | | | | |
|---|---|---|---|---|---|---|---|---|---|---|---|
| | NO. | COMPOSITION | AMOUNT (wt %) | XRD STRUCTURE | Tc (K) | Tg (K) | Tx (K) | ΔTx (K) | Tm (K) | Tg/Tm | Tx/Tm |
| COMPARATIVE EXAMPLE | 1 | $Fe_{76.4}Cr_2P_{9.3}C_{2.2}B_{5.7}Si_{4.4}$ | 0.25 | AMORPHOUS | 576 | 749 | 784 | 35 | 1311 | 0.571 | 0.598 |
| EXAMPLE | 2 | $Fe_{76.9}Cr_2P_{10.8}C_{2.2}B_{4.2}Si_{3.9}$ | 0.25 | AMORPHOUS | 568 | 739 | 768 | 29 | 1305 | 0.566 | 0.589 |
| EXAMPLE | 3 | $Fe_{77.4}Cr_2P_{10.8}C_{6.8}B_2Si_1$ | 0.25 | AMORPHOUS | 538 | 718 | 743 | 25 | 1258 | 0.571 | 0.591 |
| EXAMPLE | 4 | $Fe_{77.4}Cr_2P_{10.8}C_{6.3}B_2Si_{1.5}$ | 0.25 | AMORPHOUS | 539 | 725 | 748 | 23 | 1282 | 0.566 | 0.583 |
| EXAMPLE | 5 | $Fe_{71.4}Ni_6Cr_2P_{10.8}C_{6.8}B_2Si_1$ | 0.25 | AMORPHOUS | 571 | 703 | 729 | 26 | 1246 | 0.564 | 0.585 |
| EXAMPLE | 6 | $Fe_{71.4}Ni_6Cr_2P_{10.8}C_{7.8}B_2$ | 0.25 | AMORPHOUS | 551 | 701 | 729 | 28 | 1242 | 0.564 | 0.587 |
| EXAMPLE | 7 | $Fe_{73.4}Cr_2Ni_3Sn_1P_{10.8}C_{8.8}B_1$ | 0.25 | AMORPHOUS | 539 | 695 | 730 | 35 | 1258 | 0.552 | 0.58 |
| EXAMPLE | 8 | $Fe_{74.9}Ni_3Sn_{1.5}P_{10.8}C_{8.8}B_1$ | 0.25 | AMORPHOUS | 597 | 685 | 713 | 28 | 1223 | 0.560 | 0.583 |

TABLE 1-continued

| | NO. | CORE CHARACTERISTICS: OPTIMUM HEAT TREATMENT TEMPERATURE (° C.) | W 25 mT, 100 kHz (kW/m$^3$) | μ |
|---|---|---|---|---|
| COMPARATIVE EXAMPLE | 1 | 743.15 | 100 | 25.5 |
| EXAMPLE | 2 | 693.15 | 89 | 24.7 |
| EXAMPLE | 3 | 693.15 | 78 | 25.2 |
| EXAMPLE | 4 | 693.15 | 86 | 24.4 |
| EXAMPLE | 5 | 673.15 | 60 | 24.3 |
| EXAMPLE | 6 | 643.15 | 57 | 25.9 |
| EXAMPLE | 7 | 633.15 | 60 | 18.6 |
| EXAMPLE | 8 | 623.15 | 32 | 17.2 |

It was confirmed by an x-ray diffraction apparatus (XRD) that each sample shown in Table 1 was amorphous. In addition, the Curie temperature (Tc), the glass transition temperature (Tg), the crystallization starting temperature (Tx), and the melting point (Tm) were measured by a differential scanning calorimeter (DSC) (the temperature rise rate was 0.67K/sec for Tc, Tg, and Tx and 0.33K/sec for Tm).

The "optimum heat treatment temperature" shown in Table 1 indicates an ideal heat treatment temperature that can minimize the core loss (W) of the dust core when a heat treatment is performed thereon at a temperature rise rate of 0.67K/sec (40° C./min) and for a holding time of 1 hour.

Evaluation of the core loss (W) of the dust core shown in Table 1 was performed at a frequency of 100 kHz and a maximum magnetic flux density of 25 mT using an SY-8217 BH analyzer manufactured by Iwatsu Test Instruments Corporation.

As shown in Table 1, 0.25 wt % of Ti was added in each sample.

Figure 12:
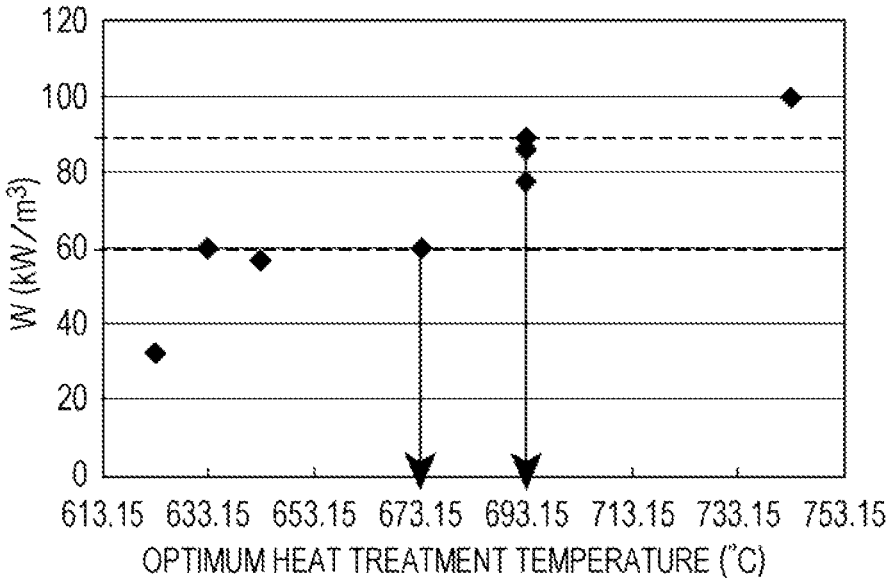
FIG. 12 is a graph showing the relationship between an optimum heat treatment temperature of the dust core and a core loss (W)

FIG. 12 is a graph showing the relationship between the optimum heat treatment temperature and the core loss (W) of the dust core shown in Table 1. As shown in FIG. 12, it was found that when the core loss (W) was set to 90 kW/m$^3$ or less, the optimum heat treatment temperature was required to be set to 693.15K (420° C.) or less.

Figure 13:
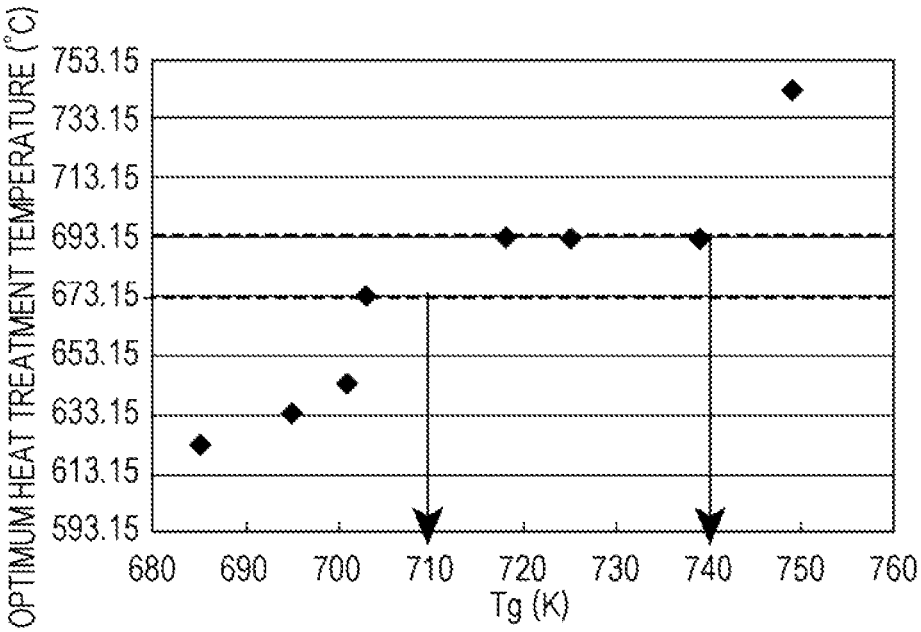
FIG. 13 is a graph showing the relationship between a glass transition temperature (Tg) of an Fe-based amorphous alloy and the optimum heat treatment temperature of the dust core.

In addition, FIG. 13 is a graph showing the relationship between the glass transition temperature (Tg) of the Fe-based amorphous alloy powder and the optimum heat treatment temperature of the dust core shown in Table 1. As shown in FIG. 13, it was found that when the optimum heat treatment temperature was set to 693.15K (420° C.) or less, the glass transition temperature (Tg) was required to be set to 740K (466.85° C.) or less.

In addition, from FIG. 12, it was found that when the core loss (W) was set to 60 kW/m$^3$ or less, the optimum heat treatment temperature was required to be set to 673.15K (400° C.) or less. In addition, from FIG. 13, it was found that when the optimum heat treatment temperature was set to 673.15K (400° C.) or less, the glass transition temperature (Tg) was required to be set to 710K (436.85° C.) or less.

As described above, from the experimental results shown in Table 1 and FIGS. 12 and 13, the applicable range of the glass transition temperature (Tg) of this example was set to 740K (466.85° C.) or less. In addition, in this example, a glass transition temperature (Tg) of 710K (436.85° C.) or less was regarded as a preferable applicable range. Experiment on addition amounts of B and Si Fe-based amorphous alloy powders having compositions shown in the following Table 2 were manufactured. Each sample was formed to have a ribbon shape by a liquid quenching method.

TABLE 2

| | NO. | COMPOSITION | B ADDITION AMOUNT (at %) | Si ADDITION AMOUNT (at %) | Ti (wt %) | ALLOY CHARACTERISTICS: XRD STRUCTURE | Tc (K) | Tg (K) | Tx (K) | ΔTx (K) | Tm (K) | Tg/Tm | Tx/Tm |
|---|---|---|---|---|---|---|---|---|---|---|---|---|---|
| EXAMPLE | 9 | $Fe_{77.4}Cr_2P_{10.8}C_{9.8}$ | 0 | 0 | 0.25 | AMORPHOUS | 537 | 682 | 718 | 36 | 1254 | 0.544 | 0.573 |
| EXAMPLE | 10 | $Fe_{77.4}Cr_2P_{10.8}C_{8.8}B_1$ | 1 | 0 | 0.25 | AMORPHOUS | 533 | 708 | 731 | 23 | 1266 | 0.559 | 0.577 |
| EXAMPLE | 11 | $Fe_{77.4}Cr_2P_{10.8}C_{7.8}B_1Si_1$ | 1 | 1 | 0.25 | AMORPHOUS | 535 | 710 | 737 | 23 | 1267 | 0.564 | 0.582 |
| EXAMPLE | 12 | $Fe_{77.4}Cr_2P_{10.8}C_{7.8}B_2$ | 2 | 0 | 0.25 | AMORPHOUS | 536 | 710 | 742 | 31 | 1277 | 0.557 | 0.581 |
| EXAMPLE | 3 | $Fe_{77.4}Cr_2P_{10.8}C_{6.8}B_2Si_1$ | 2 | 1 | 0.25 | AMORPHOUS | 538 | 718 | 743 | 25 | 1258 | 0.571 | 0.591 |
| EXAMPLE | 4 | $Fe_{77.4}Cr_2P_{10.8}C_{6.3}B_2Si_{1.5}$ | 2 | 1.5 | 0.25 | AMORPHOUS | 539 | 725 | 748 | 23 | 1282 | 0.566 | 0.583 |
| EXAMPLE | 13 | $Fe_{77.4}Cr_2P_{10.8}C_{5.8}B_2Si_2$ | 2 | 2 | 0.25 | AMORPHOUS | 544 | 721 | 747 | 26 | 1284 | 0.562 | 0.582 |
| EXAMPLE | 14 | $Fe_{77.4}Cr_2P_{10.8}C_{6.8}B_3Si_1$ | 3 | 1 | 0.25 | AMORPHOUS | 540 | 723 | 752 | 29 | 1294 | 0.559 | 0.581 |
| EXAMPLE | 15 | $Fe_{77.4}Cr_2P_{10.8}C_{6.8}B_3$ | 3 | 0 | 0.25 | AMORPHOUS | 534 | 717 | 750 | 33 | 1293 | 0.555 | 0.580 |
| COMPARATIVE EXAMPLE | 16 | $Fe_{76.4}Cr_2P_{10.8}C_{2.2}B_{3.2}Si_{5.4}$ | 3.2 | 5.4 | 0.25 | AMORPHOUS | 569 | 741 | 774 | 33 | 1296 | 0.572 | 0.597 |
| EXAMPLE | 2 | $Fe_{76.9}Cr_2P_{10.8}C_{2.2}B_{4.2}Si_{3.9}$ | 4.2 | 3.9 | 0.25 | AMORPHOUS | 568 | 739 | 768 | 29 | 1305 | 0.566 | 0.589 |
| COMPARATIVE EXAMPLE | 17 | $Fe_{76.4}Cr_2P_{10.8}C_{2.2}B_{4.2}Si_{4.4}$ | 4.2 | 4.4 | 0.25 | AMORPHOUS | 567 | 745 | 776 | 31 | 1308 | 0.570 | 0.593 |

As shown in Table 2, 0.25 wt % of Ti was added in each sample.

In Sample Nos. 3, 4, and 9 to 15 (all Examples) shown in Table 2, the addition amounts of Fe, Cr, and P in the Fe—Cr—P—C—B—Si were fixed, and the addition amounts of C, B, and Si were each changed. In addition, in Sample No. 2 (Example), the Fe amount was set to be slightly smaller than that of each of Sample Nos. 9 to 15. Sample Nos. 16 and 17 (Comparative Examples) each had a composition similar to that of Sample No. 2 but contained a larger amount of Si than that of Sample No. 2.

As shown in Table 2, it was found that when the addition amount z of B was set in a range of 0 to 4.2 at %, and the addition amount t of Si was set in a range of 0 to 3.9 at %, an amorphous substance could be formed, and at the same time, the glass transition temperature (Tg) could be set to 740K (466.85° C.) or less.

In addition, as shown in Table 2, it was found that when the addition amount z of B was set in a range of 0 to 2 at %, the glass transition temperature (Tg) could be more effectively decreased. In addition, it was found that when the addition amount t of Si was set in a range of 0 to 1 at %, the glass transition temperature (Tg) could be more effectively decreased.

In addition, it was found that when the addition amount z of B was set in a range of 0 to 2 at %, the addition amount t of Si was set in a range of 0 to 1 at %, and furthermore, (the addition amount z of B+ the addition amount t of Si) was set in a range of 0 to 2 at %, the glass transition temperature (Tg) could be set to 710K (436.85° C.) or less.

On the other hand, in Sample Nos. 16 and 17, which were Comparative Examples, shown in Table 2, the glass transition temperature (Tg) was higher than 740K (466.85° C.).

Experiment on Addition Amount of Ni

Fe-based amorphous alloy powders having compositions shown in the following Table 3 were manufactured. Each sample was formed to have a ribbon shape by a liquid quenching method. [Table 3]

As shown in Table 3, 0.25 wt % of Ti was added in each sample.

In Sample Nos. 18 to 25 (all Examples) shown in Table 3, the addition amounts of Cr, P, C, B, and Si in the Fe—Ni—Cr—P—C—B—Si were fixed, and the addition amount of Fe and the addition amount of Ni were changed. As shown in Table 3, it was found that even when the addition amount a of Ni was increased to 10 at %, an amorphous substance could be obtained. In addition, in each Sample, the glass transition temperature (Tg) was 720K (446.85° C.) or less, and the reduced vitrification temperature (Tg/Tm) was 0.54 or more.

Figure 14:
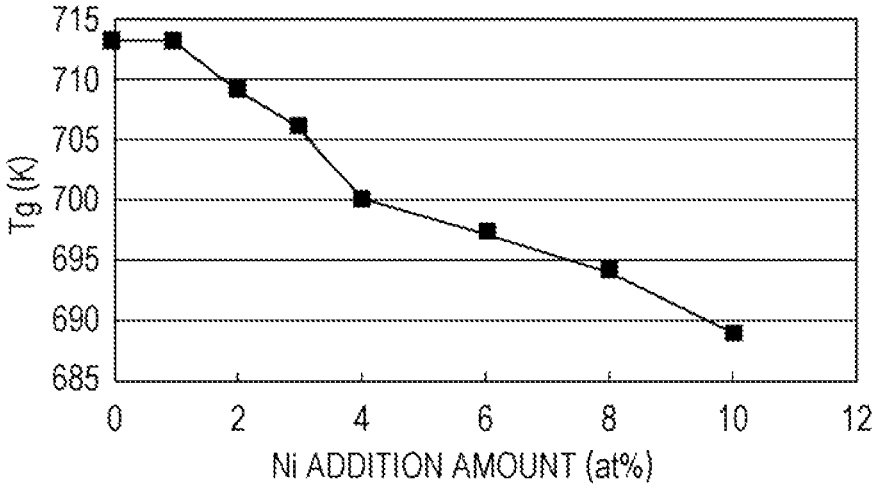
FIG. 14 is a graph showing the relationship between a Ni addition amount in an Fe-based amorphous alloy and the glass transition temperature (Tg) thereof.
Figure 15:
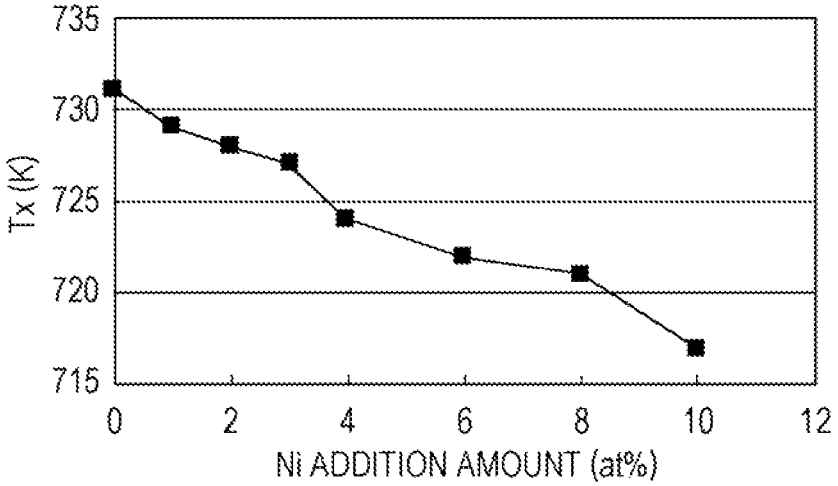
FIG. 15 is a graph showing the relationship between the Ni addition amount in the Fe-based amorphous alloy and a crystallization starting temperature (Tx) thereof.
Figure 16:
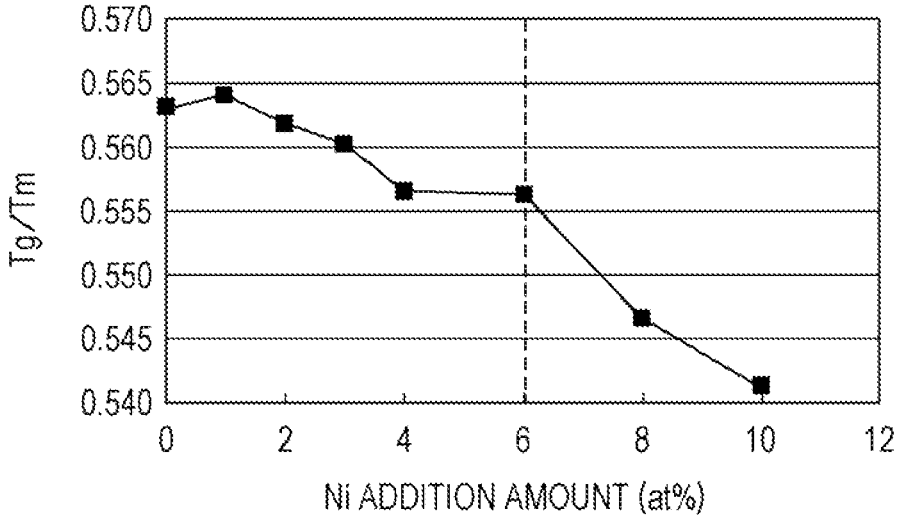
FIG. 16 is a graph showing the relationship between the Ni addition amount in the Fe-based amorphous alloy and a reduced vitrification temperature (Tg/Tm) thereof.
Figure 17:
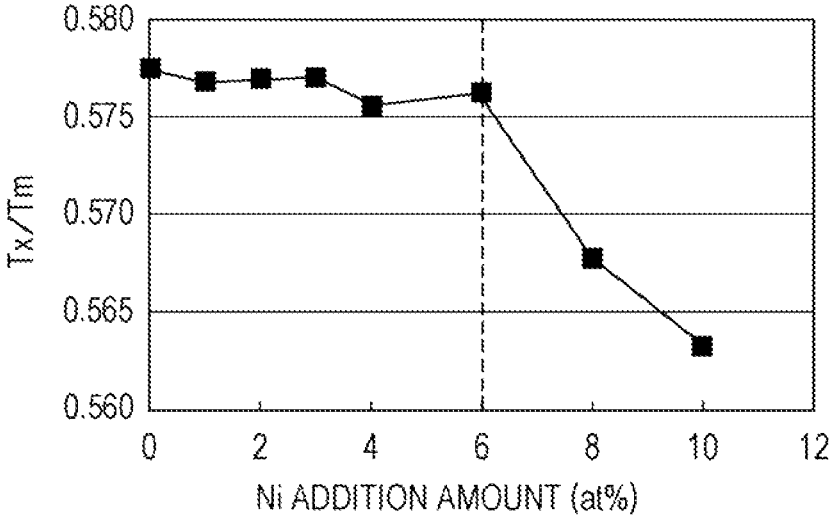
FIG. 17 is a graph showing the relationship between the Ni addition amount in the Fe-based amorphous alloy and Tx/Tm thereof.

FIG. 14 is graph showing the relationship between the Ni addition amount in the Fe-based amorphous alloy and the glass transition temperature (Tg) thereof, FIG. 15 is a graph showing the relationship between the Ni addition amount in the Fe-based amorphous alloy and the crystallization starting temperature (Tx) thereof, FIG. 16 is a graph showing the relationship between the Ni addition amount in the Fe-based amorphous alloy and the reduced vitrification temperature (Tg/Tm) thereof, and FIG. 17 is a graph showing the relationship between the Ni addition amount in the Fe-based amorphous alloy and Tx/Tm thereof.

It was found that when the addition amount a of Ni was increased as shown in FIGS. 14 and 15, the glass transition temperature (Tg) and the crystallization starting temperature (Tx) were gradually decreased.

In addition, as shown in FIGS. 16 and 17, it was found that even when the addition amount a of Ni was increased to approximately 6 at %, although a high reduced vitrification temperature (Tg/Tm) and Tx/Tm could be maintained, when the addition amount a of Ni was more than 6 at %, the reduced vitrification temperature (Tg/Tm) and Tx/Tm were rapidly decreased.

In this example, as the glass transition temperature (Tg) was decreased, it is necessary to enhance the amorphous forming ability by increasing the reduced vitrification temperature (Tg/Tm); hence, the addition amount a of Ni was set in a range of 0 to 10 at % and preferably in a range of 0 to 6 at %.

In addition, it was found that when the addition amount a of Ni was set in a range of 4 to 6 at %, the glass transition temperature (Tg) could be decreased, and at the same time, a high reduced vitrification temperature (Tg/Tm) and Tx/Tm could be stably obtained.

Experiment on Addition Amount of Sn

Fe-based amorphous alloy powders having compositions shown in the following Table 4 were manufactured. Each sample was formed to have a ribbon shape by a liquid quenching method.

TABLE 3

| NO. | COMPOSITION | Ni ADDITION AMOUNT (at %) | Ti ADDITION AMOUNT (wt %) | ALLOY CHARACTERISTICS XRD STRUCTURE | Tc (K) | Tg (K) | Tx (K) | ΔTx (K) | Tm (K) | Tg/Tm | Tx/Tm |
|---|---|---|---|---|---|---|---|---|---|---|---|
| 18 | $Fe_{75.9}Cr_4P_{10.8}C_{6.3}B_2Si_1$ | 0 | 0.25 | AMORPHOUS | 498 | 713 | 731 | 18 | 1266 | 0.563 | 0.577 |
| 19 | $Fe_{74.9}Ni_1Cr_4P_{10.8}C_{6.3}B_2Si_1$ | 1 | 0.25 | AMORPHOUS | 502 | 713 | 729 | 16 | 1264 | 0.564 | 0.577 |
| 20 | $Fe_{73.9}Ni_2Cr_4P_{10.8}C_{6.3}B_2Si_1$ | 2 | 0.25 | AMORPHOUS | 506 | 709 | 728 | 19 | 1262 | 0.562 | 0.577 |
| 21 | $Fe_{72.9}Ni_3Cr_4P_{10.8}C_{6.3}B_2Si_1$ | 3 | 0.25 | AMORPHOUS | 511 | 706 | 727 | 21 | 1260 | 0.560 | 0.577 |
| 22 | $Fe_{71.9}Ni_4Cr_4P_{10.8}C_{6.3}B_2Si_1$ | 4 | 0.25 | AMORPHOUS | 514 | 700 | 724 | 24 | 1258 | 0.556 | 0.576 |
| 23 | $Fe_{69.9}Ni_6Cr_4P_{10.8}C_{6.3}B_2Si_1$ | 6 | 0.25 | AMORPHOUS | 520 | 697 | 722 | 25 | 1253 | 0.556 | 0.576 |
| 24 | $Fe_{67.9}Ni_8Cr_4P_{10.8}C_{6.3}B_2Si_1$ | 8 | 0.25 | AMORPHOUS | 521 | 694 | 721 | 27 | 1270 | 0.546 | 0.568 |
| 25 | $Fe_{65.9}Ni_{10}Cr_4P_{10.8}C_{6.3}B_2Si_1$ | 10 | 0.25 | AMORPHOUS | 525 | 689 | 717 | 28 | 1273 | 0.541 | 0.563 |

TABLE 4

| No. | COMPOSITION | Sn ADDITION AMOUNT (at %) | Ti ADDITION AMOUNT (wt %) | ALLOY CHARACTERISTICS XRD STRUCTURE | Tc (K) | Tg (K) | Tx (K) | ΔTx (K) | Tm (K) | Tg/Tm | Tx/Tm | POWDER CHARACTERISTICS $O_2$ CONCENTRATION (ppm) |
|---|---|---|---|---|---|---|---|---|---|---|---|---|
| 26 | $Fe_{77.4}Cr_2P_{10.8}C_{2.2}B_{4.2}Si_{3.4}$ | 0 | 0.25 | AMORPHOUS | 561 | 742 | 789 | 38 | 1301 | 0.570 | 0.606 | 0.13 |
| 27 | $Fe_{76.4}Sn_1Cr_2P_{10.8}C_{2.2}B_{4.2}Si_{3.4}$ | 1 | 0.25 | AMORPHOUS | 575 | 748 | 791 | 43 | 1283 | 0.583 | 0.617 | |
| 28 | $Fe_{75.4}Sn_2Cr_2P_{10.8}C_{2.2}B_{4.2}Si_{3.4}$ | 2 | 0.25 | AMORPHOUS | 575 | 729 | 794 | 65 | 1296 | 0.563 | 0.613 | 0.23 |
| 29 | $Fe_{74.4}Sn_3Cr_2P_{10.8}C_{2.2}B_{4.2}Si_{3.4}$ | 3 | 0.25 | AMORPHOUS | 572 | 738 | 776 | 38 | 1294 | 0.570 | 0.600 | |

As shown in Table 4, 0.25 wt % of Ti was added in each Sample.

In Sample Nos. 26 to 29 shown in Table 4, the addition amounts of Cr, P, C, B, and Si in the Fe—Sn—Cr—P—C—B—Si were fixed, and the addition amount of Fe and the addition amount Sn were changed. It was found that even when the addition amount of Sn was increased to 3 at %, an amorphous substance could be obtained.

However, as shown in Table 4, it was found that when the addition amount b of Sn was increased, the concentration of oxygen contained in the Fe-based amorphous alloy was increased, and the corrosion resistance was degraded. Hence, it was found that the addition amount b of Sn was required to be decreased to the minimum necessary.

Hence, in this example, in order to suppress the degradation in corrosion resistance and to maintain a high amorphous forming ability, the addition amount b of Sn was set in a range of 0 to 3 at % and preferably in a range of 0 to 2 at %.

In addition, when the addition amount b of Sn was set to 2 to 3 at %, although Tx/Tm was decreased as described above, the reduced vitrification temperature (Tg/Tm) could be increased.

Experiment on Addition Amount of P and Addition Amount of C

Fe-based amorphous alloy powders having compositions shown in the following Table 5 were manufactured. Each sample was formed to have a ribbon shape by a liquid quenching method.

TABLE 5

| | No. | COMPOSITION | P ADDITION AMOUNT (at %) | C ADDITION AMOUNT (at %) | Ti (wt %) | ALLOY CHARACTERISTICS XRD STRUCTURE | Tc (K) | Tg (K) | Tx (K) | ΔTx (K) | Tm (K) | Tg/Tm | Tx/Tm |
|---|---|---|---|---|---|---|---|---|---|---|---|---|---|
| EXAMPLE | 9 | $Fe_{77.4}Cr_2P_{10.8}C_{9.8}$ | 10.8 | 9.8 | 0.25 | AMORPHOUS | 537 | 682 | 718 | 36 | 1254 | 0.544 | 0.573 |
| EXAMPLE | 31 | $Fe_{77.4}Cr_2P_{8.8}C_{9.8}B_1Si_1$ | 8.8 | 9.8 | 0.25 | AMORPHOUS | 555 | 682 | 726 | 44 | 1305 | 0.523 | 0.556 |
| EXAMPLE | 32 | $Fe_{77.4}Cr_2P_{8.8}C_{9.8}B_2$ | 8.8 | 9.8 | 0.25 | AMORPHOUS | 545 | 700 | 729 | 29 | 1303 | 0.537 | 0.559 |
| EXAMPLE | 33 | $Fe_{77.4}Cr_2P_{6.8}C_{9.8}B_3Si_1$ | 6.8 | 9.8 | 0.25 | AMORPHOUS | 565 | 701 | 737 | 36 | 1336 | 0.525 | 0.552 |
| EXAMPLE | 34 | $Fe_{77.4}Cr_2P_{6.8}C_{9.8}B_4$ | 6.8 | 9.8 | 0.25 | AMORPHOUS | 563 | 708 | 741 | 33 | 1347 | 0.526 | 0.550 |
| EXAMPLE | 10 | $Fe_{77.4}Cr_2P_{10.8}C_{8.8}B_1$ | 10.8 | 8.8 | 0.25 | AMORPHOUS | 533 | 708 | 731 | 23 | 1266 | 0.559 | 0.577 |
| EXAMPLE | 12 | $Fe_{77.4}Cr_2P_{10.8}C_{7.8}B_2$ | 10.8 | 7.8 | 0.25 | AMORPHOUS | 536 | 711 | 742 | 31 | 1277 | 0.557 | 0.581 |
| EXAMPLE | 35 | $Fe_{77.4}Cr_2P_{10.8}C_{5.8}B_2Si_2$ | 10.8 | 5.8 | 0.25 | AMORPHOUS | 544 | 721 | 747 | 26 | 1284 | 0.562 | 0.582 |
| EXAMPLE | 15 | $Fe_{77.4}Cr_2P_{10.8}C_{6.8}B_3$ | 10.8 | 6.8 | 0.25 | AMORPHOUS | 534 | 717 | 750 | 33 | 1293 | 0.555 | 0.580 |
| EXAMPLE | 14 | $Fe_{77.4}Cr_2P_{10.8}C_{6.8}B_3Si_1$ | 10.8 | 6.8 | 0.25 | AMORPHOUS | 540 | 723 | 752 | 29 | 1294 | 0.559 | 0.581 |
| COMPARATIVE EXAMPLE | 17 | $Fe_{76.4}Cr_2P_{10.8}C_{2.2}B_{4.2}Si_{4.4}$ | 10.8 | 2.2 | 0.25 | AMORPHOUS | 567 | 745 | 776 | 31 | 1308 | 0.57 | 0.593 |

Figure 18:
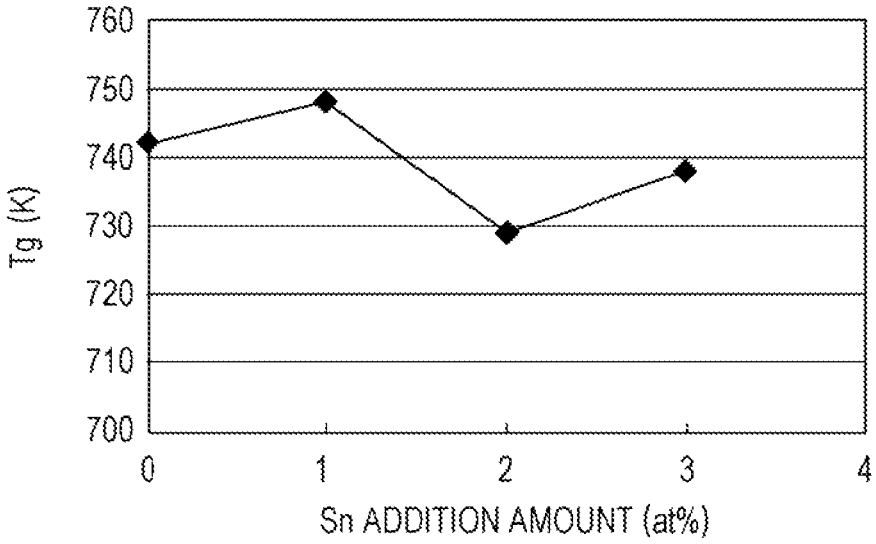
FIG. 18 is a graph showing the relationship between a Sn addition amount in an Fe-based amorphous alloy and the glass transition temperature (Tg) thereof.
Figure 19:
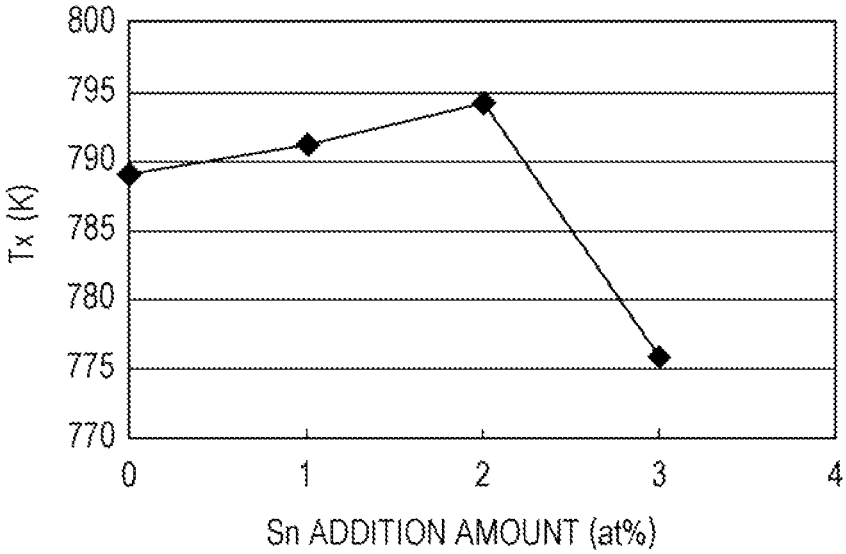
FIG. 19 is a graph showing the relationship between the Sn addition amount in the Fe-based amorphous alloy and the crystallization starting temperature (Tx) thereof.
Figure 20:
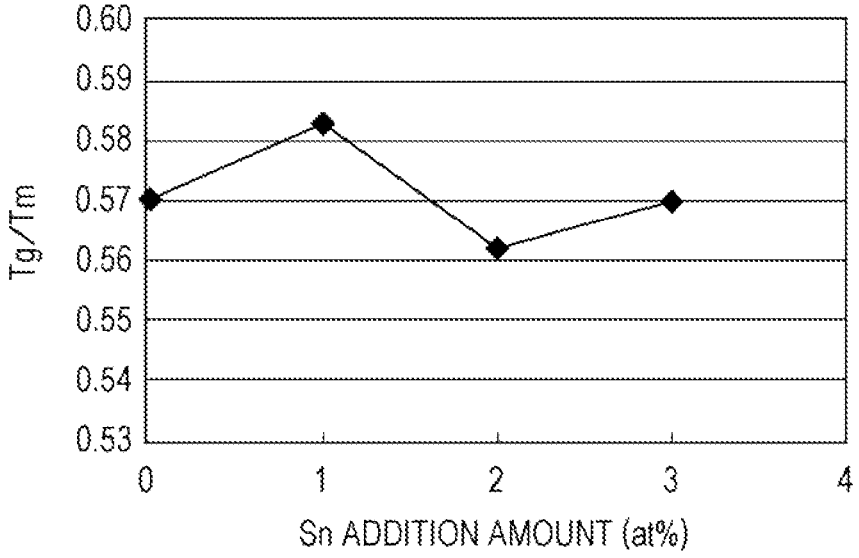
FIG. 20 is a graph showing the relationship between the Sn addition amount in the Fe-based amorphous alloy and the reduced vitrification temperature (Tg/Tm) thereof.
Figure 21:
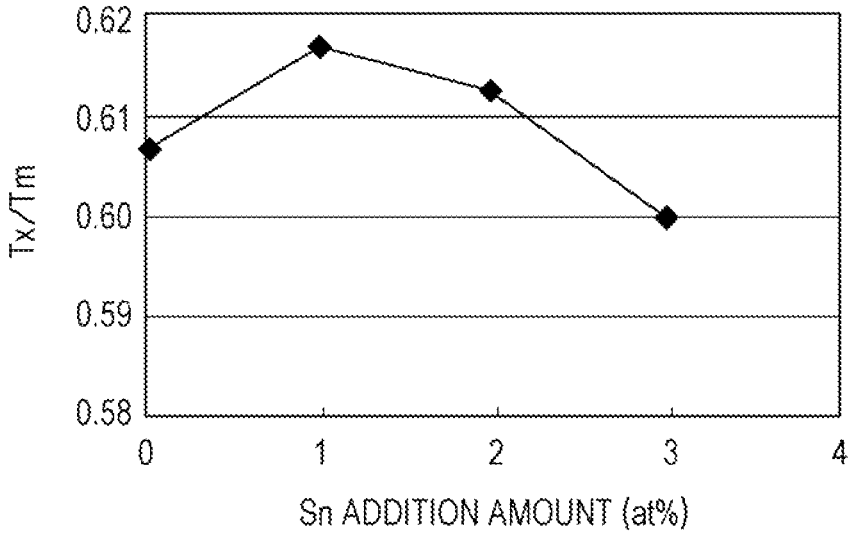
FIG. 21 is a graph showing the relationship between the Sn addition amount in the Fe-based amorphous alloy and Tx/Tm thereof.

FIG. 18 is a graph showing the relationship between the Sn addition amount in the Fe-based amorphous alloy and the glass transition temperature (Tg) thereof, FIG. 19 is a graph showing the relationship between the Sn addition amount in the Fe-based amorphous alloy and the crystallization starting temperature (Tx) thereof, FIG. 20 is a graph showing the relationship between the Sn addition amount in the Fe-based amorphous alloy and the reduced vitrification temperature (Tg/Tm) thereof, and FIG. 21 is a graph showing the relationship between the Sn addition amount in the Fe-based amorphous alloy and Tx/Tm thereof.

When the addition amount b of Sn was increased as shown in FIG. 18, the glass transition temperature (Tg) tended to be decreased.

In addition, as shown in FIG. 21, it was found that when the addition amount b of Sn was set to 3 at %, Tx/Tm was decreased, and the amorphous forming ability was degraded.

As shown in Table 5, 0.25 wt % of Ti was added in each Sample.

In Sample Nos. 9, 10, 12, 14, 15, and 31 to 35 (all Examples) shown in Table 5, the addition amounts of Fe and Cr in the Fe—Cr—P—C—B—Si were fixed, and the addition amounts of P, C, B, and Si were changed.

As shown in Table 5, it was found that when the addition amount x of P was controlled in a range of 6.8 to 10.8 at %, and the addition amount y of C was controlled in a range of 2.2 to 9.8 at %, an amorphous substance could be obtained. In addition, in each example, the glass transition temperature (Tg) could be set to 740K (466.85° C.) or less, and the reduced vitrification temperature (Tg/Tm) could be set to 0.52 or more.

Figure 22:
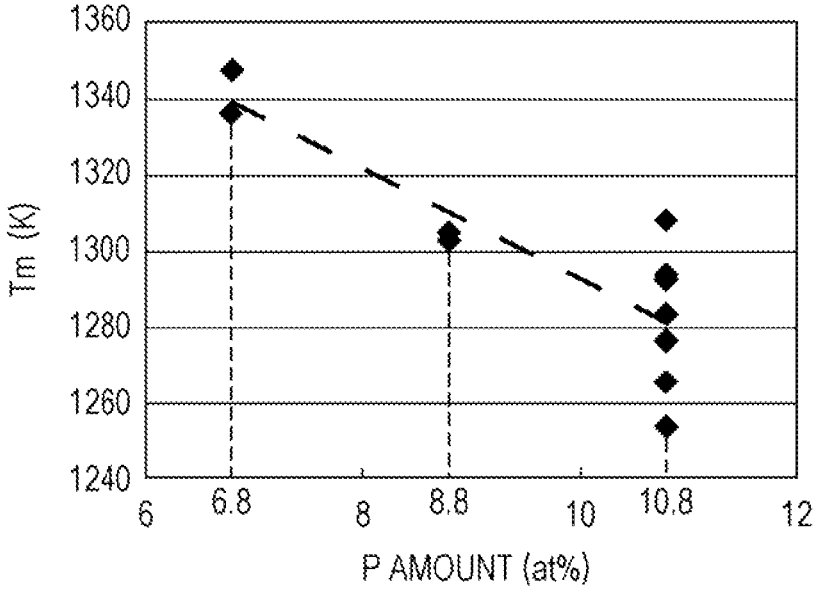
FIG. 22 is a graph showing the relationship between a P addition amount in an Fe-based amorphous alloy and a melting point (Tm) thereof.
Figure 23:
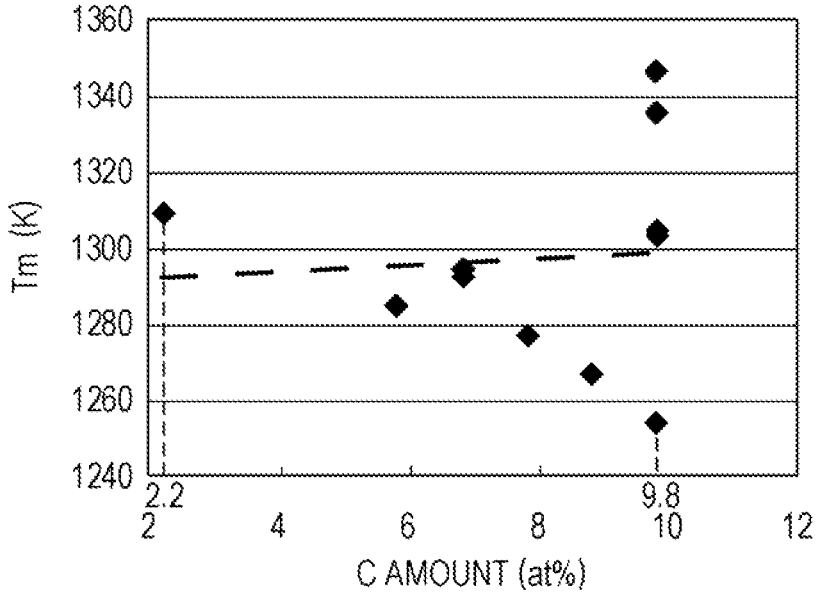
FIG. 23 is a graph showing the relationship between a C addition amount in an Fe-based amorphous alloy and the melting point (Tm) thereof.

FIG. 22 is a graph showing the relationship between the addition amount x of P in the Fe-based amorphous alloy and the melting point (Tm) thereof, and FIG. 23 is a graph showing the relationship between the addition amount y of C in the Fe-based amorphous alloy and the melting point (Tm) thereof.

In this Example, although the glass transition temperature (Tg) could be set to 740K (466.85° C.) or less and preferably 710K (436.85° C.) or less, since the glass transition temperature (Tg) was decreased, in order to enhance the amorphous forming ability represented by Tg/Tm, the melting point (Tm) was required to be decreased. In addition, as shown in FIGS. 22 and 23, it is believed that the melting point (Tm) is more dependent on the P amount than on the C amount.

In particular, it was found that when the addition amount x of P was set in a range of 8.8 to 10.8 at %, the melting point (Tm) could be effectively decreased, and hence the reduced vitrification temperature (Tg/Tm) could be increased.

Experiment on Addition Amount of Cr

Figure 24:
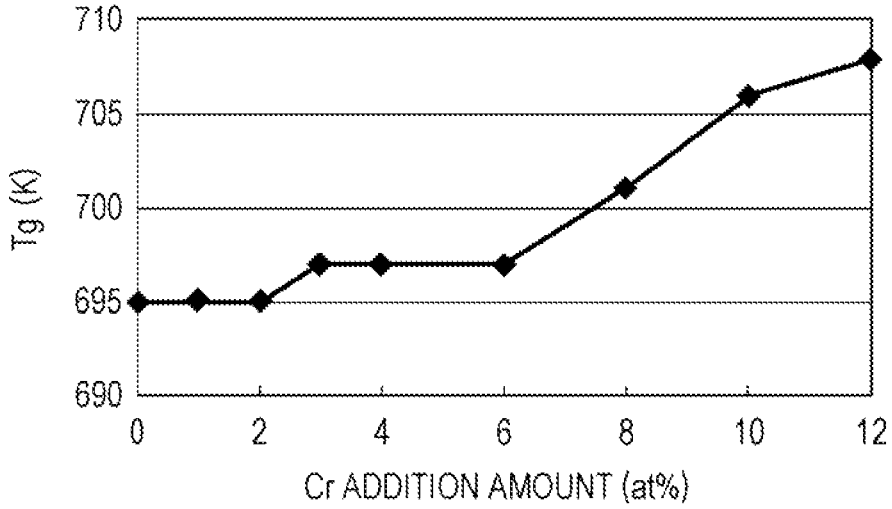
FIG. 24 is a graph showing the relationship between a Cr addition amount in an Fe-based amorphous alloy and the glass transition temperature (Tg) thereof.

Fe-based amorphous alloy powders having compositions shown in the following Table 6 were manufactured. Each sample was formed to have a ribbon shape by a liquid quenching method.

a low glass transition temperature (Tg) and a saturation magnetization Is of 1.0 T or more. In addition, a preferable addition amount c of Cr was set in a range of 0 to 2 at %. As shown in FIG. 24, when the addition amount c of Cr was set in a range of 0 to 2 at %, the glass transition temperature (Tg) could be set to be low regardless of the Cr amount.

In addition, it was also found that when the addition amount c of Cr was set in a range of 1 to 2 at %, the corrosion resistance could be improved, a low glass transition temperature (Tg) could also be stably obtained, and furthermore high magnetization could be maintained.

Formation of Fe-based amorphous alloy powder by addition of Ti, Al, and Mn as metal element M Fe-based amorphous alloy powders represented by $(Fe_{71.4}Ni_6Cr_2P_{10.8}C_{7.8}B_2)_{100-\alpha}M_\alpha$ were each manufactured by a water atomizing method.

TABLE 6

| No. | COMPOSITION | Cr ADDITION AMOUNT (at %) | ALLOY CHARACTERISTICS XRD STRUCTURE | Tc (K) | Tg (K) | Tx (K) | ΔTx (K) | Tm (K) | Tg/Tm | Tx/Tm | Is (T) | POWDER CHARACTERISTICS $O_2$ CONCENTRATION (ppm) |
|---|---|---|---|---|---|---|---|---|---|---|---|---|
| 36 | $Fe_{73.9}Ni_6P_{10.8}C_{6.3}B_2Si_1$ | 0 | AMORPHOUS | 607 | 695 | 711 | 16 | 1240 | 0.560 | 0.573 | 1.45 | 0.15 |
| 37 | $Fe_{72.9}Ni_6Cr_1P_{10.8}C_{6.3}B_2Si_1$ | 1 | AMORPHOUS | 587 | 695 | 714 | 19 | 1239 | 0.561 | 0.576 | 1.36 | 0.12 |
| 38 | $Fe_{71.9}Ni_6Cr_2P_{10.8}C_{6.3}B_2Si_1$ | 2 | AMORPHOUS | 565 | 695 | 716 | 21 | 1243 | 0.559 | 0.576 | 1.28 | 0.12 |
| 39 | $Fe_{70.9}Ni_6Cr_3P_{10.8}C_{6.3}B_2Si_1$ | 3 | AMORPHOUS | 541 | 697 | 719 | 22 | 1249 | 0.558 | 0.576 | 1.23 | 0.1 |
| 40 | $Fe_{69.9}Ni_6Cr_4P_{10.8}C_{6.3}B_2Si_1$ | 4 | AMORPHOUS | 520 | 697 | 722 | 25 | 1253 | 0.556 | 0.576 | 1.2 | 0.11 |
| 41 | $Fe_{67.9}Ni_6Cr_6P_{10.8}C_{6.3}B_2Si_1$ | 6 | AMORPHOUS | 486 | 697 | 725 | 28 | 1261 | 0.553 | 0.575 | 1.04 | |
| 42 | $Fe_{65.9}Ni_6Cr_8P_{10.8}C_{6.3}B_2Si_1$ | 8 | AMORPHOUS | 475 | 701 | 729 | 28 | 1271 | 0.552 | 0.574 | 0.9 | 0.13 |
| 43 | $Fe_{63.9}Ni_6Cr_{10}P_{10.8}C_{6.3}B_2Si_1$ | 10 | AMORPHOUS | 431 | 706 | 740 | 34 | 1279 | 0.552 | 0.579 | 0.7 | |
| 44 | $Fe_{61.9}Ni_6Cr_{12}P_{10.8}C_{6.3}B_2Si_1$ | 12 | AMORPHOUS | 406 | 708 | 742 | 34 | 1290 | 0.549 | 0.575 | 0.58 | 0.15 |

As shown in Table 6, 0.25 wt % of Ti was added in each Sample.

In Samples shown in Table 6, the addition amounts of Ni, P, C, B, and Si in the Fe—Ni—Cr—P—C—B—Si were fixed, and the addition amounts of Fe and Cr were changed. As shown in Table 6, it was found that when the addition amount of Cr was increased, the concentration of oxygen contained in the Fe-based amorphous alloy was gradually decreased, and the corrosion resistance was improved.

Figure 25:
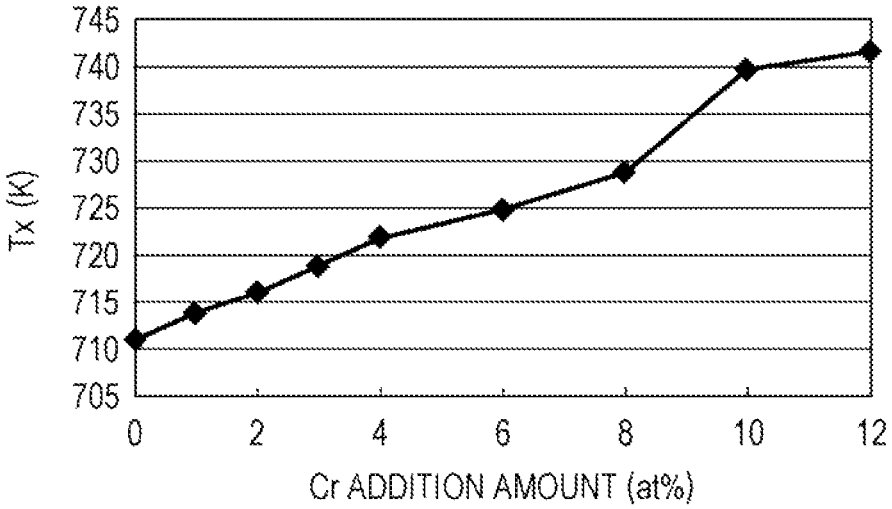
FIG. 25 is a graph showing the relationship between the Cr addition amount in the Fe-based amorphous alloy and the crystallization starting temperature (Tx) thereof.
Figure 26:
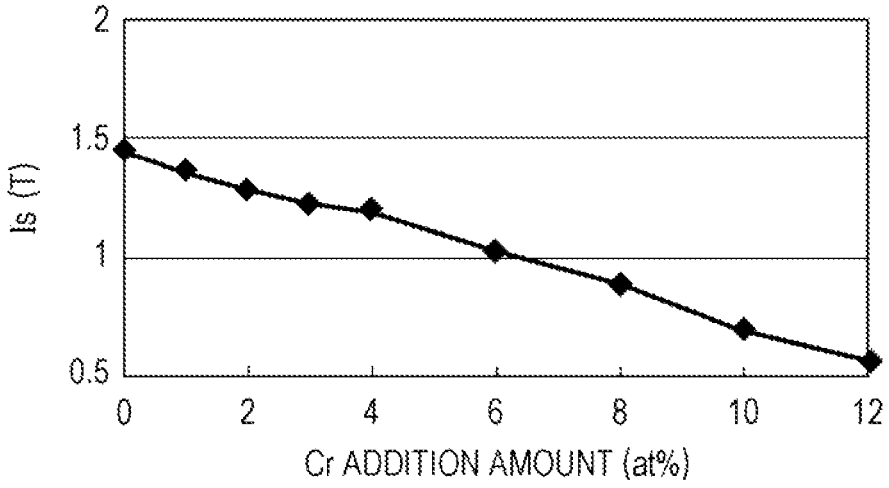
FIG. 26 is a graph showing the relationship between the Cr addition amount in the Fe-based amorphous alloy and the saturation magnetization Is.

FIG. 24 is a graph showing the relationship between the addition amount of Cr in the Fe-based amorphous alloy and the glass transition temperature (Tg) thereof, FIG. 25 is a graph showing the relationship between the addition amount of Cr in the Fe-based amorphous alloy and the crystallization starting temperature (Tx) thereof, and FIG. 26 is a graph showing the relationship between the addition amount of Cr in the Fe-based amorphous alloy and the saturation magnetization Is.

As shown in FIG. 24, it was found that when the addition amount of Cr was increased, the glass transition temperature (Tg) was gradually increased. In addition, as shown in Table 6 and FIG. 26, it was found that when the addition amount of Cr was increased, the saturation magnetization Is was gradually decreased. In addition, the saturation magnetization Is was measured by a vibrating sample magnetometer (VSM).

As shown in FIGS. 24 and 26 and Table 6, the addition amount c of Cr was set in a range of 0 to 6 at % so as to obtain

TABLE 7

| POWDER No. | Ti (wt %) | Al (wt %) | Mn (wt %) |
|---|---|---|---|
| 45 | 0.05 | <0.005 | 0.19 |
| 46 | 0.06 | <0.005 | 0.18 |
| 47 | 0.05 | <0.005 | 0.18 |
| 48 | 0.06 | <0.005 | 0.19 |
| 49 | 0.09 | <0.005 | 0.19 |
| 50 | 0.27 | <0.005 | 0.19 |
| 51 | 0.44 | <0.005 | 0.23 |
| 52 | 0.23 | <0.005 | 0.18 |
| 53 | 0.24 | <0.005 | 0.18 |
| 54 | 0.07 | <0.005 | 0.19 |
| 55 | 0.18 | <0.005 | 0.19 |
| 56 | 0.20 | <0.005 | 0.21 |
| 57 | 0.22 | <0.005 | 0.20 |
| 58 | 0.22 | <0.005 | 0.21 |
| 59 | 0.27 | <0.005 | 0.18 |
| 60 | 0.20 | <0.005 | 0.22 |

In this case, in Tables 1 to 6, although the addition amount of each element in the Fe—Ni—Sn—Cr—P—C—B—Si is represented by at %, in Table 7, each element was represented by wt %.

As shown in Table 7, as the metal element M, Ti, Al, and Mn were added. The addition amount of Al was in a range of more than 0 wt % to less than 0.005 wt %. In addition, since the other constituent elements other than the element M in the table were all represented by the formula $Fe_{71.4}Ni_6Cr_2P_{10.8}C_{7.8}B_2$, description of these elements is omitted. In this embodiment, the addition amount of the metal element M is defined in a range of 0.04 to 0.6 wt %, and in all Examples shown in Table 7, the range described above was satisfied.

Since Al and Mn are elements each having a high activity as Ti is, when a small amount of each of Ti, Al, and Mn is added, the metal element M can be aggregated at the powder surface to form a thin passivation layer, and hence, besides the decrease in Tg caused by a decrease in addition amount of Si and B, an excellent corrosion resistance, a high magnetic permeability, and a low core loss can be obtained by the addition of the metal element M.

What is claimed is:

1. An Fe-based amorphous alloy powder having a composition represented by a formula: $(Fe_{100-a-b-c-x-y-z-t}Ni_aSn_bCr_cP_xC_yB_zSi_t)_{100-\alpha}M_\alpha$, wherein an addition amount a of Ni satisfies 0 at %≤a≤10 at %, an addition amount b of Sn satisfies 0 at %≤b≤3 at %, an addition amount c of Cr satisfies 0 at %≤c≤6 at %, an addition amount x of P satisfies 6.8 at %≤x≤10.8 at %, an addition amount y of C satisfies 2.2 at %≤y≤9.8 at %, an addition amount z of B satisfies 0 at %≤z≤4.2 at %, and an addition amount t of Si satisfies 0 at %≤t≤3.9 at %, wherein a metal element M is at least one selected from the group consisting of Ti, Al, Mn, Zr, Hf, V, Nb, Ta, Mo, and W, and an addition amount a of the metal element M satisfies 0.04 wt %≤α≤0.6 wt %, and wherein a concentration of the metal element M is higher in a powder surface layer than that inside the powder.

2. The Fe-based amorphous alloy powder according to claim 1, wherein the addition amount z of B satisfies 0 at %≤z≤2 at %, the addition amount t of Si satisfies 0 at %≤t≤1 at %, and a sum of the addition amount z of B and the addition amount t of Si satisfies 0 at %≤z+t≤2 at %.

3. The Fe-based amorphous alloy powder according to claim 1, wherein the alloy powder includes non-zero addition amounts of B and Si, and the addition amount z of B is greater than the addition amount t of Si.

4. The Fe-based amorphous alloy powder according to claim 1, wherein the addition amount a of the metal element M satisfies 0.1 wt %≤α≤0.6 wt %.

5. The Fe-based amorphous alloy powder according to claim 1, wherein the metal element M includes Ti.

6. The Fe-based amorphous alloy powder according to claim 1, wherein the metal element M includes Ti, Al, and Mn.

7. The Fe-based amorphous alloy powder according to claim 1, wherein the alloy powder includes Ni or Sn.

8. The Fe-based amorphous alloy powder according to claim 1, wherein the addition amount a of Ni satisfies 0 at %≤a≤6 at %.

9. The Fe-based amorphous alloy powder according to claim 1, wherein the addition amount b of Sn satisfies 0 at %≤b≤2 at %.

10. The Fe-based amorphous alloy powder according to claim 1, wherein the addition amount c of Cr satisfies 0 at %≤c≤2 at %.

11. The Fe-based amorphous alloy powder according to claim 1, wherein the addition amount x of P satisfies 8.8 at %≤x≤10.8 at %.

12. The Fe-based amorphous alloy powder according to claim 1, wherein the addition amount a of Ni satisfies 0 at %≤a≤6 at %, the addition amount b of Sn satisfies 0 at %≤b≤2 at %, the addition amount c of Cr satisfies 0 at %≤c≤2 at %, the addition amount x of P satisfies 8.8 at %≤x≤10.8 at %, the addition amount y of C satisfies 2.2 at %≤y≤9.8 at %, the addition amount z of B satisfies 0 at %≤z≤2 at %, the addition amount t of Si satisfies 0 at %≤t≤1 at %, the sum of the addition amount z of B and the addition amount t of Si satisfies 0 at %≤z+t≤2 at %, and the addition amount a of the metal element M satisfies 0.1 wt %≤α≤0.6 wt %.

13. The Fe-based amorphous alloy powder according to claim 1, wherein the alloy powder has an aspect ratio of greater than 1 to 1.4.

14. The Fe-based amorphous alloy powder according to claim 13, wherein the alloy powder has an aspect ratio of 1.2 to 1.4.

15. The Fe-based amorphous alloy powder according to claim 1, wherein the alloy powder includes a non-zero addition amount of Si as a composition element, and the concentration of the metal element M in the powder surface layer is higher than a concentration of Si.

16. A dust core comprising:

the Fe-based amorphous alloy powder according to claim 1; and a binding material solidifying the Fe-based amorphous alloy powder.

17. A coil-embedded dust core comprising:

a dust core including the Fe-based amorphous alloy powder according to claim 1 and a binding material solidifying the Fe-based amorphous alloy powder; and a coil encapsulated in the dust core.

18. The coil-embedded dust core according to claim 17, wherein the coil is an edgewise coil.

* * * * *